US005199448A

United States Patent [19]

Parker

[11] Patent Number: 5,199,448

[45] Date of Patent: * Apr. 6, 1993

[54] METHOD AND APPARATUS FOR SEPARATION OF OBJECTIONABLE PARTICLES FROM TOBACCO MATERIAL

[75] Inventor: Michael P. Parker, Bedfordshire, United Kingdom

[73] Assignee: Rothmans International Tobacco (UK) Limited, United Kingdom

[ * ] Notice: The portion of the term of this patent subsequent to Nov. 12, 2008 has been disclaimed.

[21] Appl. No.: 631,119

[22] Filed: Dec. 20, 1990

Related U.S. Application Data

[63] Continuation-in-part of Ser. No. 411,134, Sep. 22, 1989, Pat. No. 5,063,944.

[30] Foreign Application Priority Data

Sep. 28, 1988 [GB] United Kingdom ..... 8822723

[51] Int. Cl.[5] ..... A24B 1/04; A24B 3/18

[52] U.S. Cl. ..... 131/110; 131/296; 131/302; 131/304

[58] Field of Search ..... 131/110, 109.2, 296, 131/304, 302, 280

[56] References Cited

U.S. PATENT DOCUMENTS 3,881,498 5/1975 Wochnowski ..... 131/302
4,932,424 6/1990 Liebe et al. ..... 131/304

*Primary Examiner*—Vincent Millin
*Assistant Examiner*—J. Doyle
*Attorney, Agent, or Firm*—Diller, Ramik & Wight

[57] ABSTRACT

A method of separating objectionable particles from host tobacco material which includes fluidizing the tobacco material with a fluidizing air stream to allow heavy unwanted particles to fall, to cause light unwanted particles to rise and be air transported away and to leave a carpet of acceptable material.

40 Claims, 19 Drawing Sheets

Fig. 12(a)
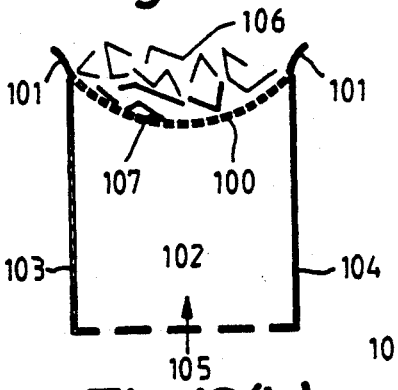
Fig. 12(b)
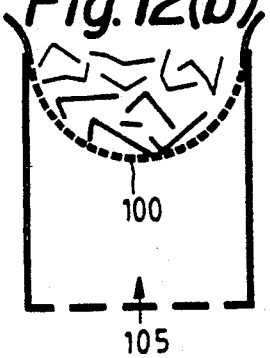
Fig. 12(c)
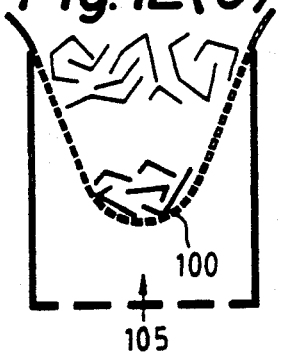
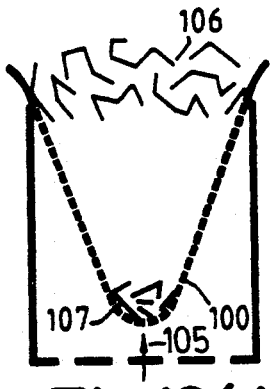
Fig. 12(d)
Fig. 13(a)
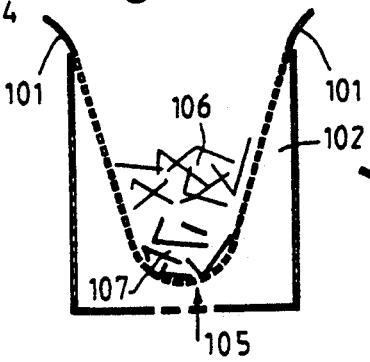
Fig. 13(b)
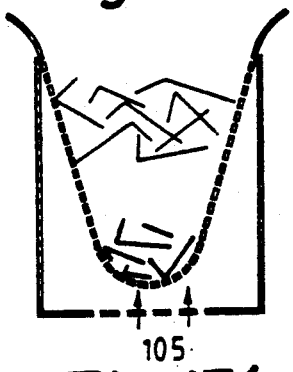
Fig. 13(c)
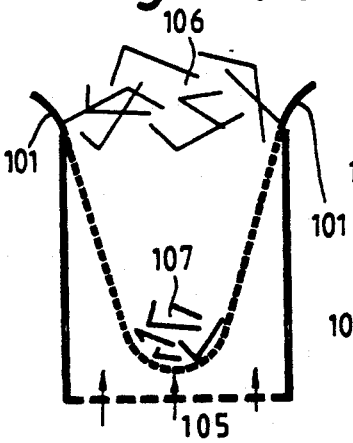
Fig. 14(a)
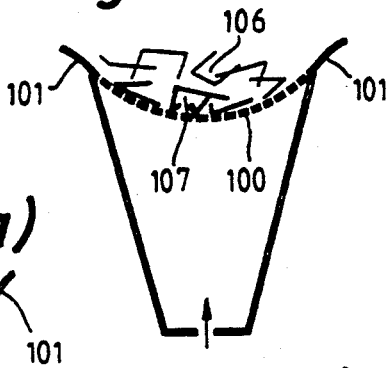
Fig. 14(b)
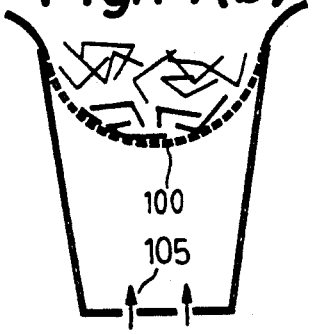
Fig. 14(c)
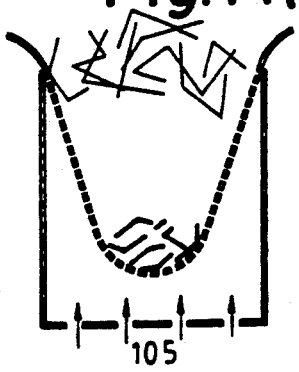
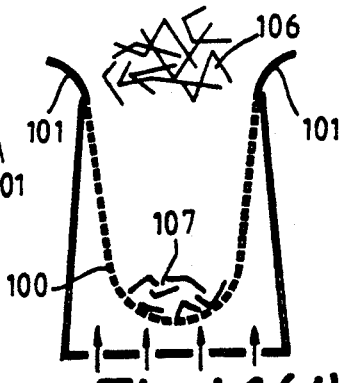
Fig. 14(d)

128
127
128
127
112
112
110
100
113
114
121
111
122
116
123
123
126
118
126
117

G
142
F
112
112
E
110
110

100
D
116
111
135
C
136
137
142
B
138
138
A
139
141
140

METHOD AND APPARATUS FOR SEPARATION OF OBJECTIONABLE PARTICLES FROM TOBACCO MATERIAL

This is a continuation in part of application Ser. No. 411,124, filed Sept. 22, 1989, now U.S. Pat. No. 5,063,944.

This invention relates to a method and apparatus for separation of objectionable particles from tobacco material, for example from cut or un-cut tobacco.

The objectionable particles may be "heavies", for example coarse cut stem pieces and/or "lights", for example particles or dust.

In processing, different tobacco components are treated in different ways before being combined to form the final blend. For example, lamina undergoes a different conditioning treatment to stem and is cut more finely. If there is some cross-contamination of tobacco type such as stem or lamina or lamina on atom, problems will occur after cutting. After cutting, some of the stem in lamina will be so coarsely cut it will be deemed to be objectionable and some of the lamina will be so finely cut it will, in the latter stages of processing, be rendered to dust. For the maintenance of quality, both the overtly large and small particles must be removed from the tobacco prior to being manufacturered into the cigarette rod.

One way of removing objectionable particles has been provided for in cigarette making machines, in that prior to forming the unwrapped cigarette rod, the tobacco in the machines is passed through a winnower and air lifted. In passing through the winnower, some heavy objectionable particles are removed. In air lifting, some of the dust passes through the machine to be removed by filtration before the air is exhausted to the atmosphere. Both of these processes are inefficient and remove only a portion of the objectionable material present. Their efficiency is also load dependent, that is, the more objectionable material present, the lower their efficiency. Their discrimination of the winnower is also poor, resulting in acceptable material being rejected with the objectionable.

Another method of removing objectionable material for example is to classify it out by air lifting. There are several styles of classification in existence. These work on the principle that the heavy particles can be separated from the light particles by passing them through a moving stream of air which carries the light particles off with it for separation later, while the heavy particles due to their mass/aerodynamic qualities are left behind.

As the light particles are usually the acceptable and less robust portion of the tobacco and the air velocities used are in the order of 3,000 ft/min or higher, this form of separation usually results in some degradation of the good tobacco components. Again discrimination between heavy and light particles is poor due to the aerodynamic shadowing and the very short time in which separation occurs.

U.S. Pat. Specification No. 4,646,759 shows apparatus for the separation of tobacco into two fractions, for example"heavies" and "lights". The tobacco is supplied to a separator unit including a vibrating conveyor and streams of air rising through the conveyer plate lift the lighter particles away. The particles most desirable for use as cigarette filler are pulled away and into an upper collector chamber and there deposited into a collector tray leaving the heavy particles to be discharged separately.

The general objective of the present invention is to effectively separate the objectionable particles from the acceptable tobacco product by a means which does not cause the acceptable tobacco components to degrade.

Specifically the objectives are:

To remove heavy objectionable particles such as coarse or uncut stem or heavy foreign objects from tobacco.

To remove light objectionable particles such as dust from tobacco.

To cool, condition or maintain the physical status of the host tobacco during the separation of the above.

To effect the above without degrading the host tobacco.

According to the present invention a method of separating objectionable particles from host tobacco material includes fluidising the tobacco material with a fluidising air stream to allow heavy unwanted particles to fall, to cause light unwanted particles to rise and be air transported away and to leave a carpet of acceptable material.

Preferably the method includes agitating the tobacco material whilst it is fluidised.

The vertical air velocity across the working zone of the bed can be low and can change from as little as 300 ft/min to 1000 ft/min, and the combination of agitation and air flow causes the tobacco to stratify and be teased open so that the dust if lifted away and the heavy particles sink to the lower strata. The average fluidised air velocity is set such that the heavy particles cannot be supported by the air flow and consequently sink.

The advantage of the invention is that tobacco components are fluidised in the fluidising air stream rather than air-lifted and transported, and as such have more time to discretely separate and do not suffer the degradation found in other separation systems.

If desired however the acceptable material may be gently air transported from the carpet. Thus sufficient time is allowed for the particles to become aerodynamically supported and separated with the acceptable material then finally being carried on a gentle air stream and lifted from the carpet and transported and as such do not suffer the same degradation found in other separation systems.

The invention also includes apparatus for the separation of objectionable particles from tobacco material comprising means for fluidising the material to form a carpet in a fluidising air stream, means for simultaneously agitating the material to release the dust and heavy particles, arranging the air flow velocity to cause the dust to rise and heavy particles to sink from said carpet, and means for removing said dust and said heavy particles.

If desired means can be incorporated for lifting the acceptable material from the carpet on a gentle removal air stream and transporting it.

Preferably the said fluidising air stream forms a stratified fluidised bed on a deck which is vibrated to cause agitation of the tobacco.

In a preferred embodiment, the said fluidised bed deck has a convoluted and at least partly perforated surface which provides peaks and troughs, the air velocity of said fluidising air stream being arranged to cause a portion of the tobacco carpet to be below the peaks but spaced above the bottoms of the troughs. As the deck is convoluted, the air volume to deck area within the bed is higher than that at the troughs of the convolutions, the resultant air velocity being such that the bottom of the fluidised carpet of the tobacco is supported below the peaks of the convolutions, teasing via the vibratory bed is effected throughout the whole tobacco carpet.

The heavy particles can be removed through openings in the deck and thus the openings can be in the form of slots in the troughs.

The heavy particles can be arranged to pass through the slots to a collector which moves them to at least one side or end of the vibratory deck.

The tobacco carpet can be transported by the fluidising deck to a position where the acceptable tobacco can be transferred by gravity onto a take off conveyer.

Alternatively the tobacco carpet can be transported by the fluidising deck to a position where the acceptable particles are gently air lifted via one or more suctions tubes at such a low velocity as to leave any remaining heavy particles behind and to be further transported to the end of the deck.

The dust can be removed through a tapered extraction hood in which the air velocity at its higher level is less than the air velocity at its lower level thus ensuring that only dust can be entrained.

If desired, the heavy particles can be delivered to a classifier for segregation and re-cycling.

The invention also includes apparatus for the separation of objectionable particles from tobacco material which comprises a deck adapted to receive thereon tobacco material at a reception end and discharge it at a discharge end, means for vibrating the said deck, means for providing as air flow through openings in the deck to fluidise the tobacco material, said deck having a convoluted surface comprising a number of longitudinally extending troughs separated by peaks, each of said troughs having a bottom, opposed side walls, and a mouth extending between adjacent said peaks, air guiding means which in combination with the shape of the troughs and peaks causes the velocity of the fluidising air passing upwardly in each of said troughs to initially increase to a located spaced away from said bottom and then decrease as it exits the mouth of said trough, to provide stratified air velocities over the deck to cause the tobacco material to form a carpet at least a portion of which is below the peaks but spaced above the bottom of the troughs and which together with the vibration of the deck agitates the carpet and causes the dust to be released and rise and heavy particles to sink, said carpet moving lengthwise along said troughs during operation toward said discharge location, means for removing the dust.

The bottom and side walls of each trough can be perforated and said air guiding means is provided by longitudinally extending baffle means which direct air to said perforations.

Preferably the baffle means are shaped to provide an air control chamber around each trough, each chamber having spaced apart baffle walls which extend downwardly from points on the trough side walls beneath the peaks to points below the bottom of the trough and a lower wall joining said baffle walls and through which air is supplied to the air control chamber.

Preferably means are provided for smoothing the flow of and pre opening the incoming tobacco. This can take the form of spreading on a vibrating deck using deflectors followed by passing the material across an air stream or by using a spiked belt or spiked roller; again this may be followed by passing the material across an air stream The invention can be performed in various ways and various embodiments will now be described by way of example and with reference to the accompanying drawings in which.

Figure 15:
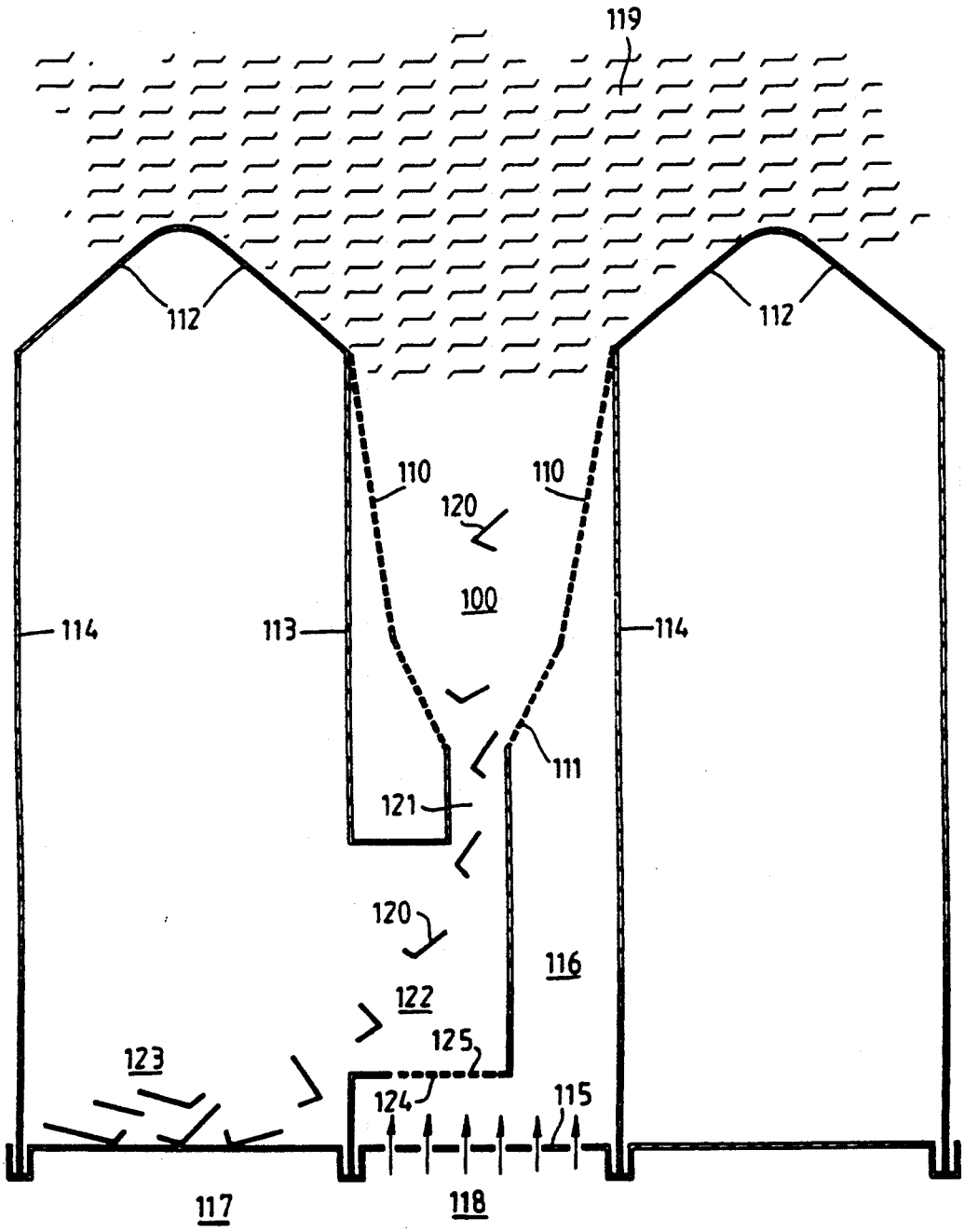
Figure 16:
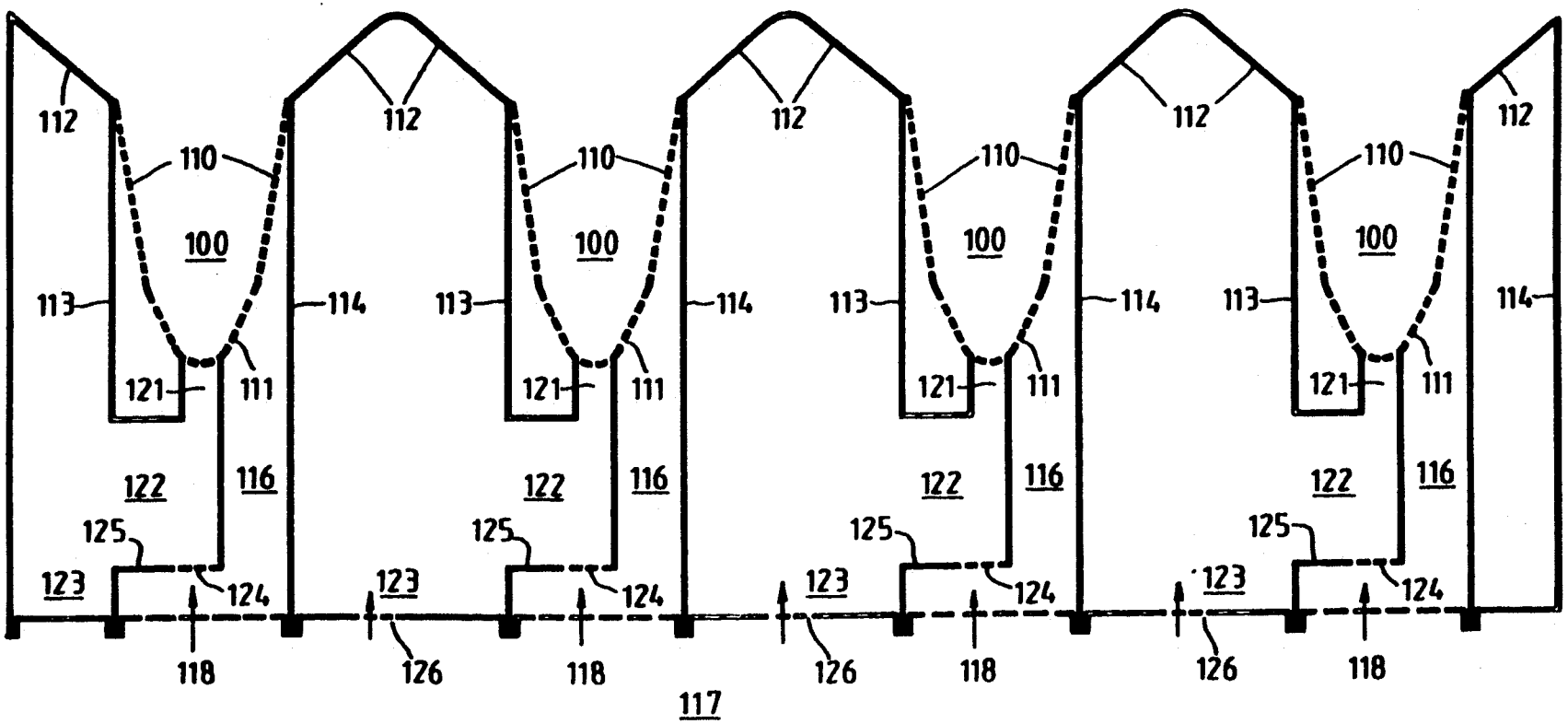
Figure 17:
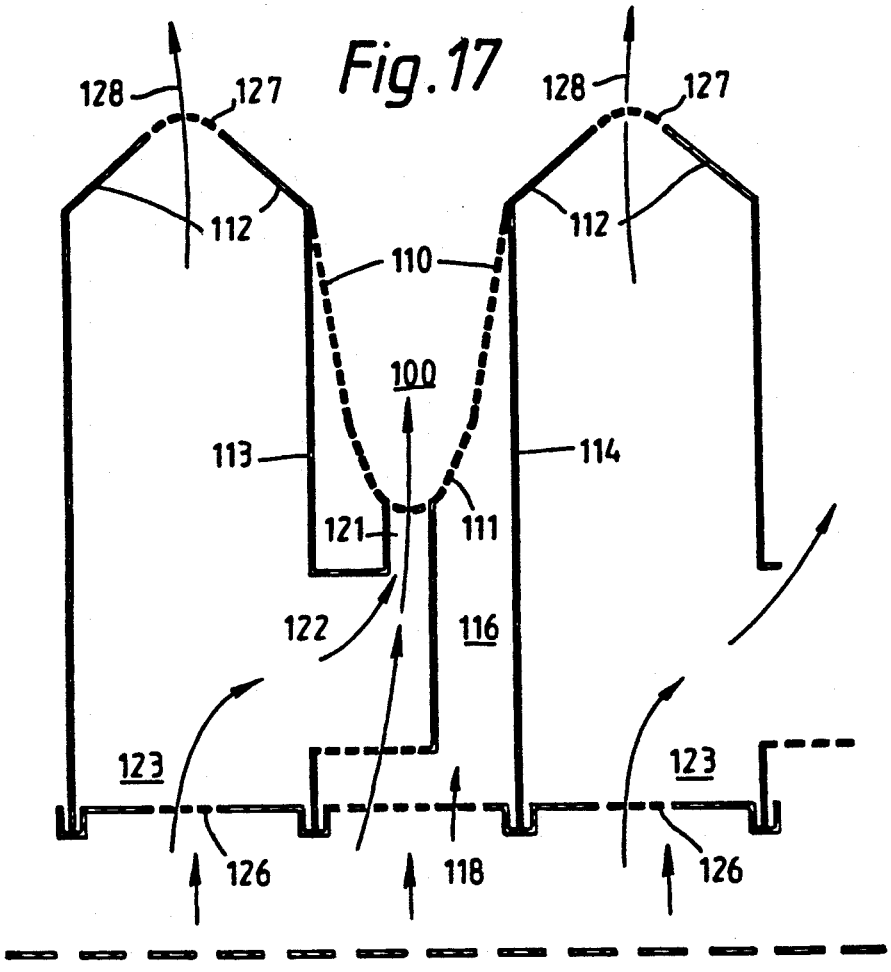
Figure 19:
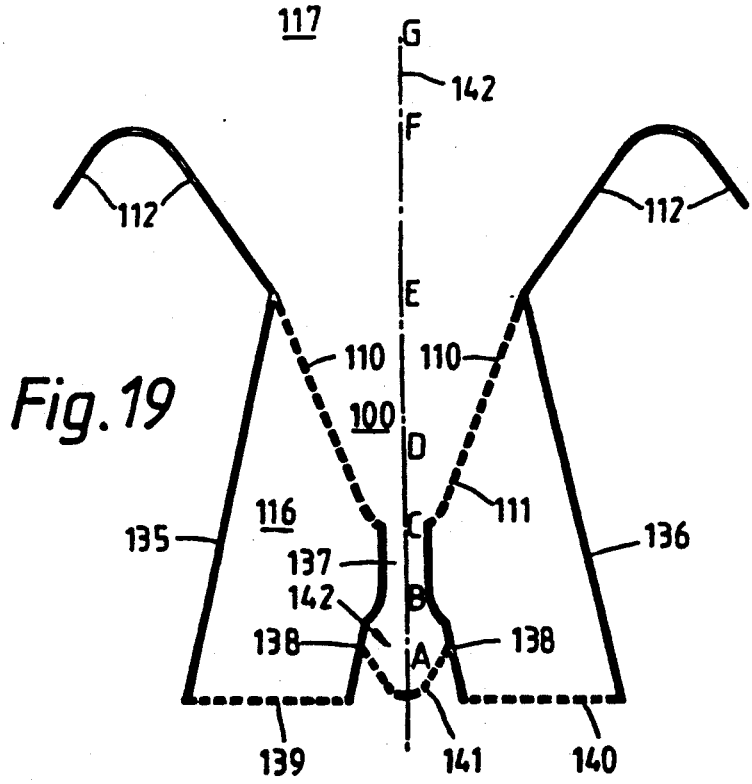
Figure 18:
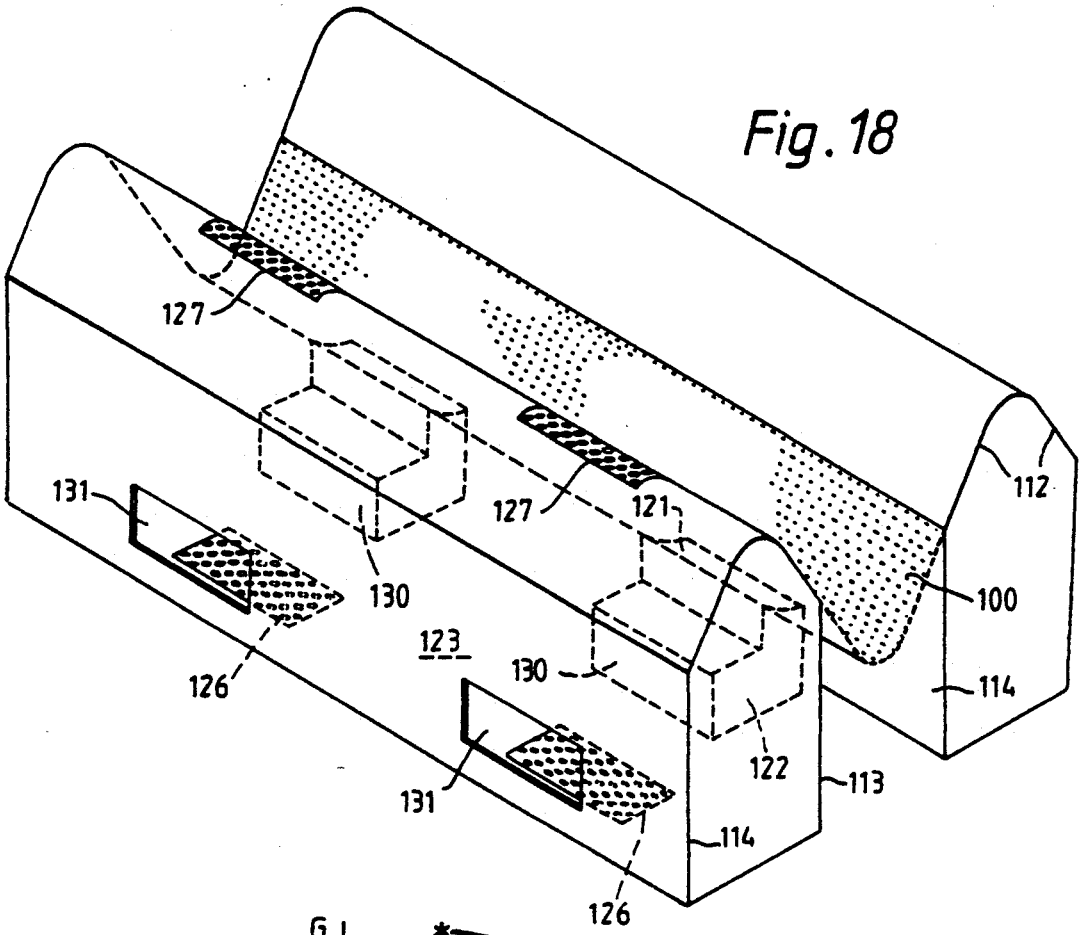
Figure 20:
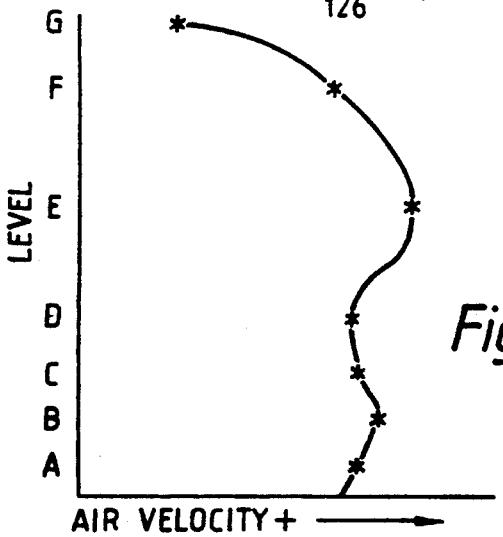
Figure 21:
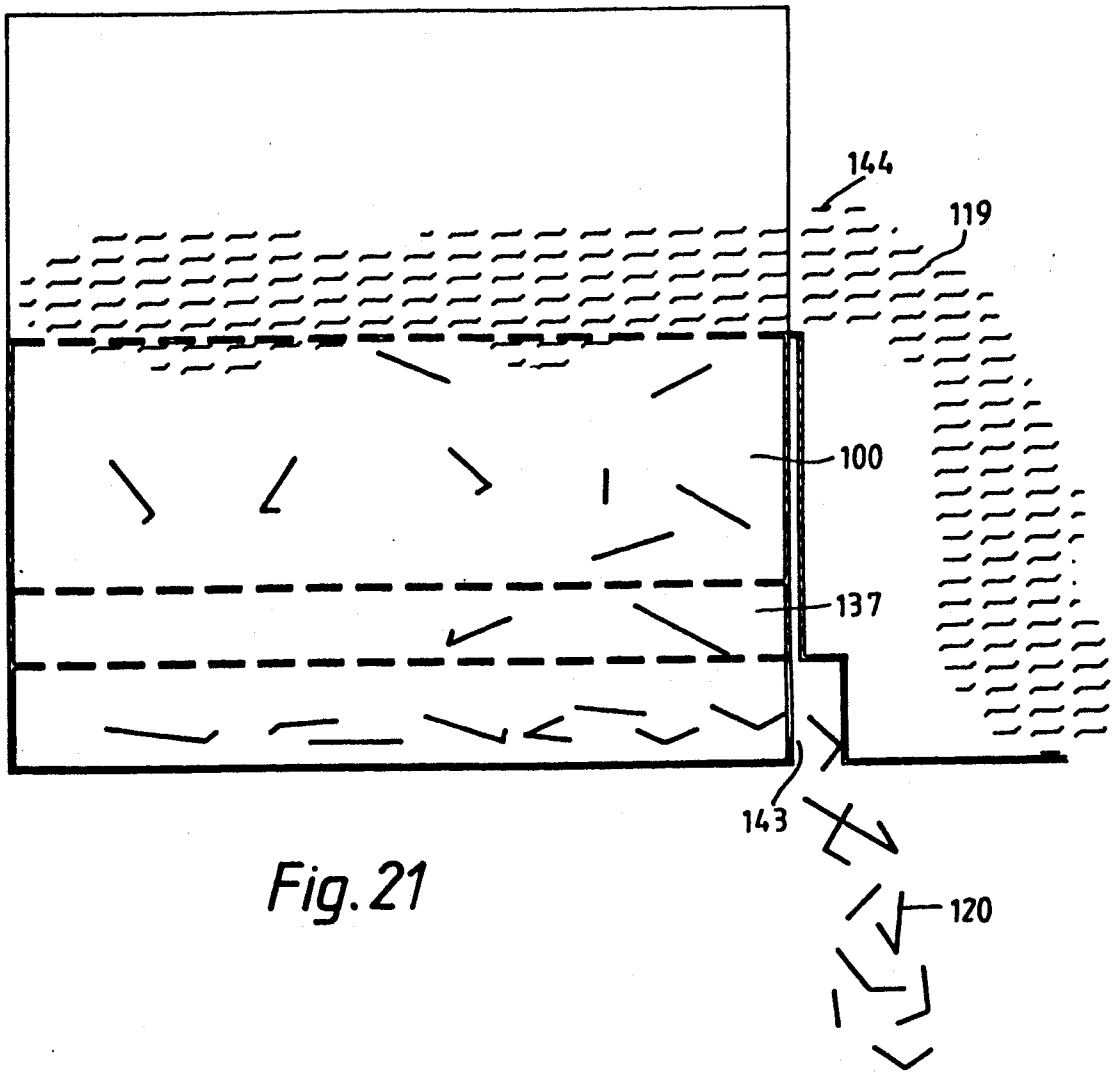
Figure 22:
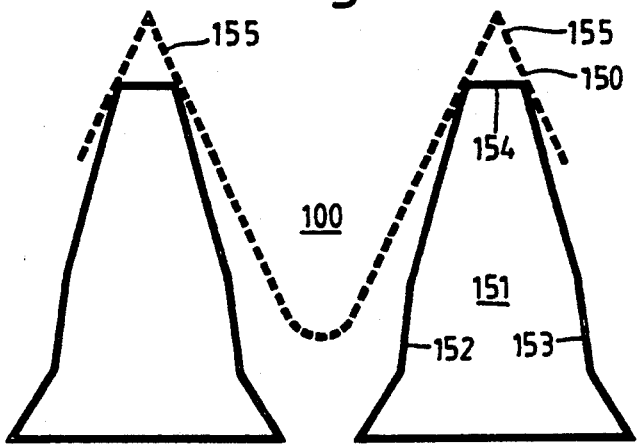
Figure 23:
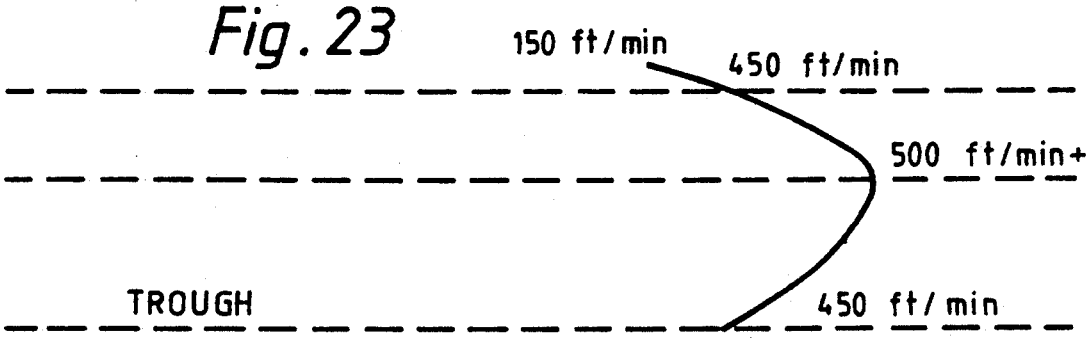
Figure 24:
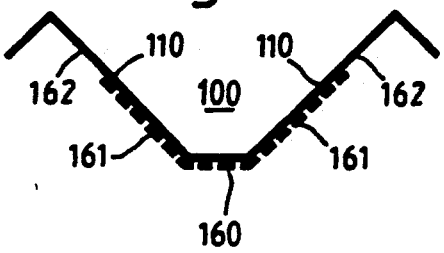
Figure 25:
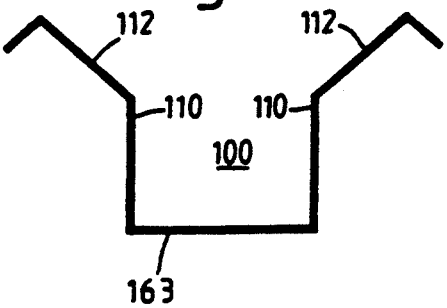
Figure 26:
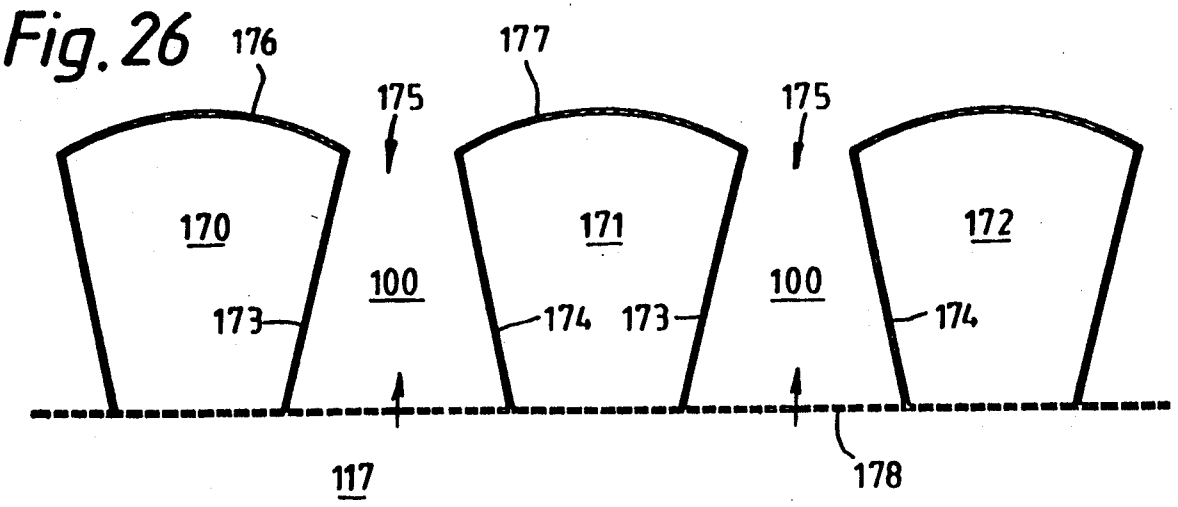
Figure 27:
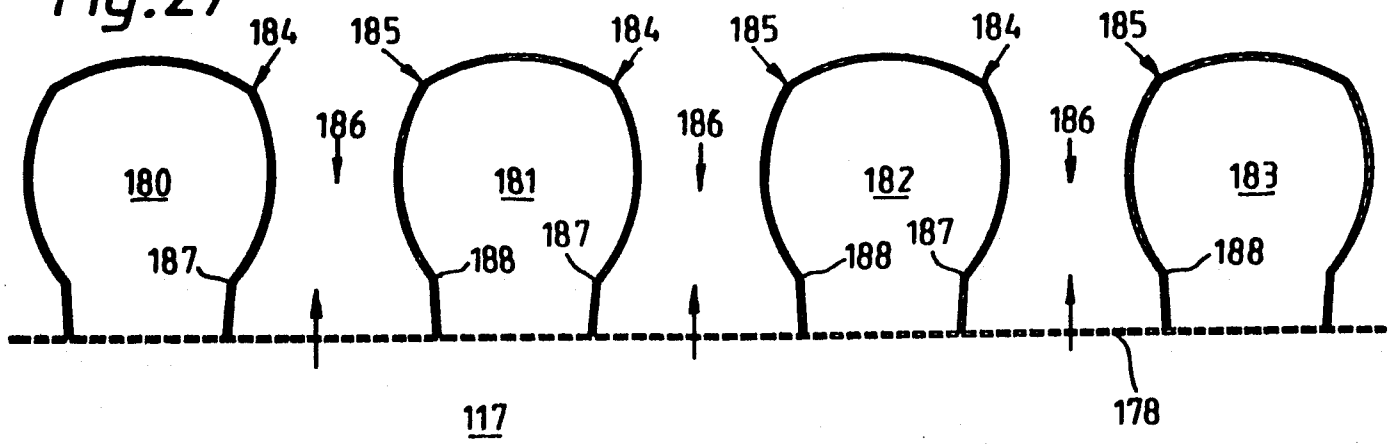
Figure 28A:
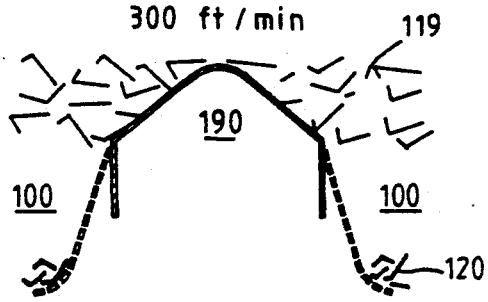
Figure 28B:
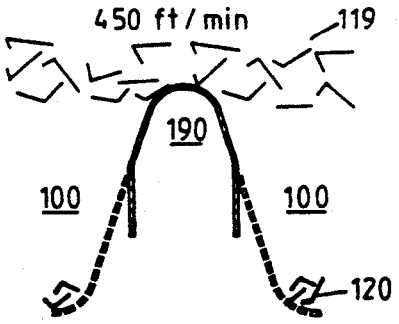
Figure 28C:
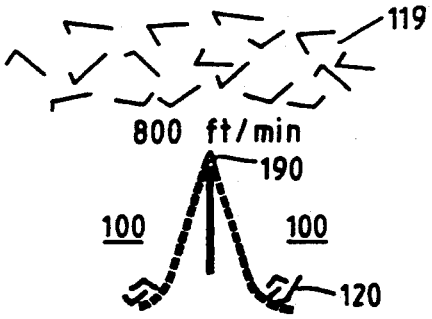
Figure 29:
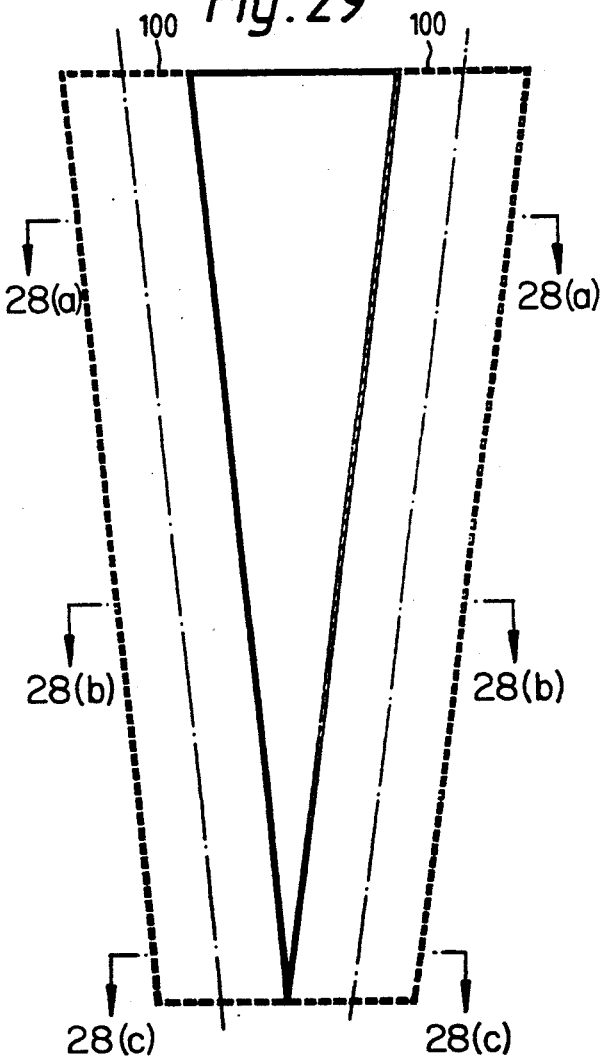
Figure 30:
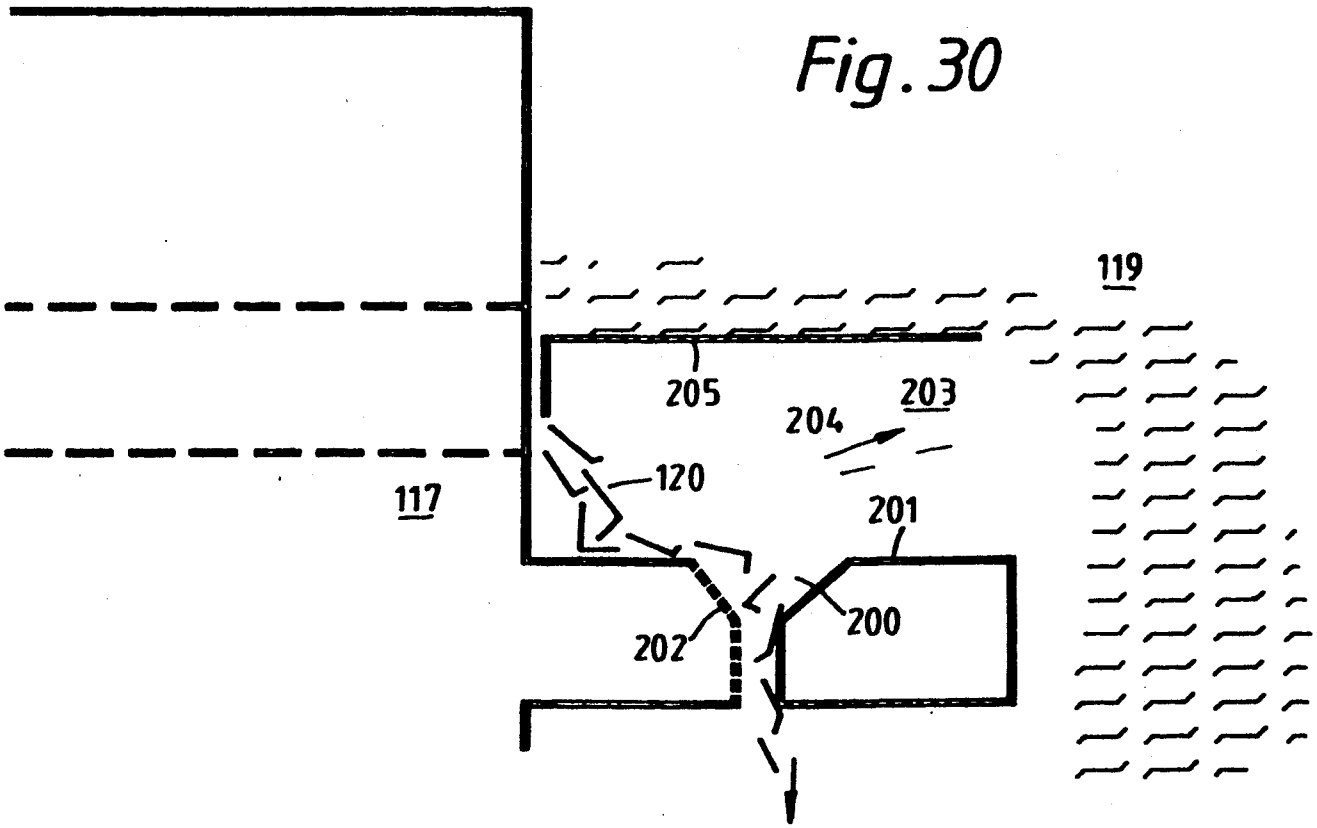

FIGS. 12(*a*)–12(*d*), 12(*a*–12(*c*) and 14(*a*)–14(*d*) are diagrammatic representations showing the principle of progressive separation of acceptable tobacco material from the heavier material;

FIG. 15 is a diagrammatic cross-sectional view of part of a separation deck showing a construction applying the principles set out in FIGS. 12, 13 and 14;

FIG. 16 is a diagrammatic cross-sectional view of a deck provided with four troughs;

FIG. 17 is a diagrammatic cross-sectional view showing an alternative construction;

FIG. 18 is a diagrammatic perspective view of the construction shown in FIG. 17;

FIG. 19 is a part cross-sectional diagrammatic view of an alternative construction;

FIG. 20 is a graph showing the air velocities at different levels in the trough of the construction shown in FIG. 19;

FIG. 21 is a cross-sectional diagrammatic view of the construction shown in FIGS. 19;

FIG. 22 is a diagrammatic cross-section through another construction according to the invention;

FIG. 23 shows a typical air velocity profile required for the apparatus to work;

FIGS. 24 and 25 are diagrammatic cross-sectional views of trough shapes;

FIGS. 26 and 27 are diagrammatic cross-sectional views of further trough shapes according to the invention;

FIG. 28(*a*)–28(*c*) show a series of cross-sections through a trough peak of the type shown in FIG. 15:

FIG. 29 is a plan view of the trough peaks shown in FIG. 28; and,

FIG. 30 shows a method of cleaning heavy materials or winnows delivered by the discharge openings in the trough.

Figure 1:
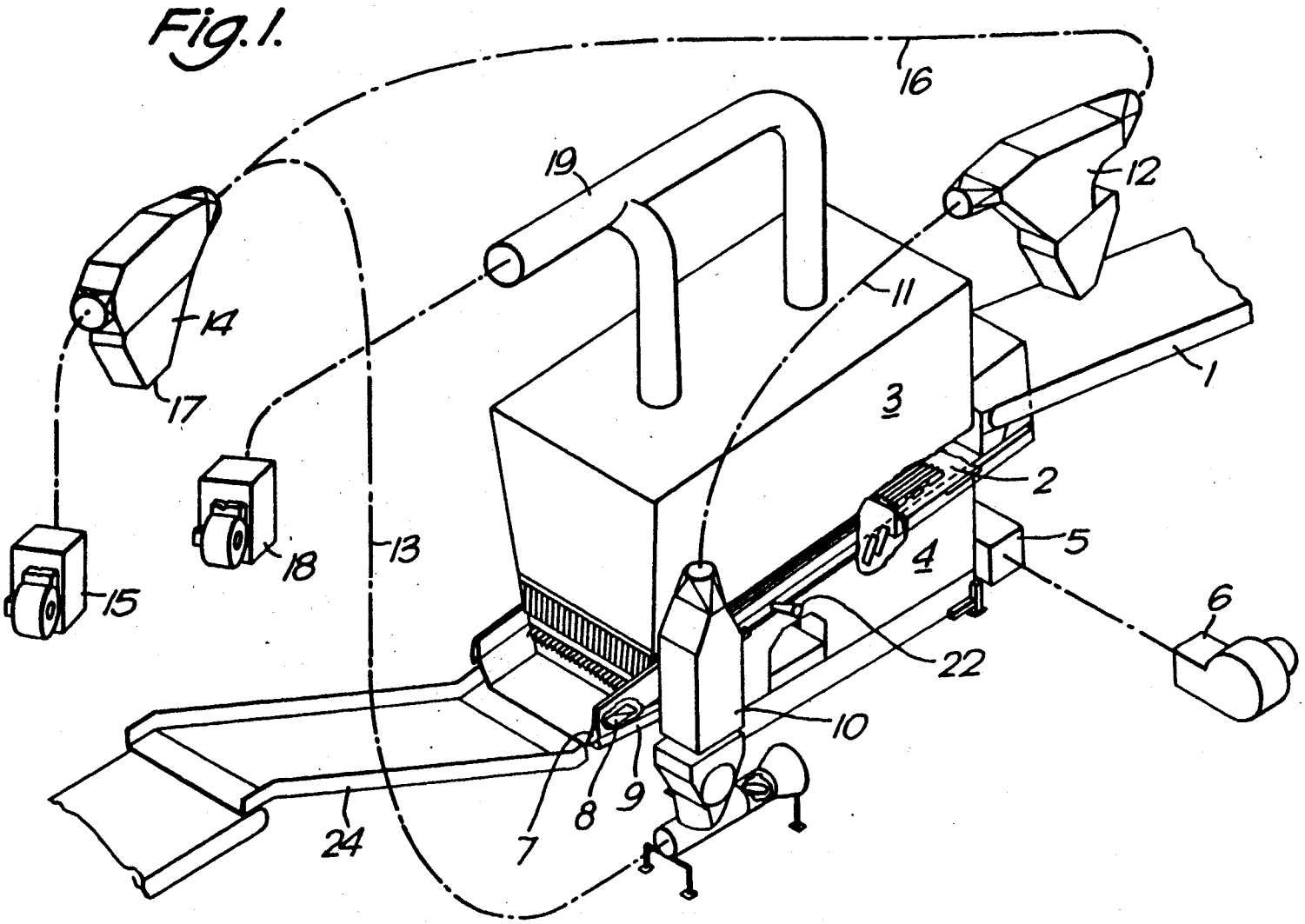
FIG. 1 is a diagrammatic view of a first embodiment of the apparatus according to the invention.

As shown in FIG. 1 of the drawings, the apparatus comprises a feed conveyer 1, which transports tobacco material to be treated onto a vibrating fluid bed deck 2. If desired, the tobacco having left conveyer 1 can be teased by a stream of air which acts to spread, separate and untangle the material As the material reaches the deck 2, means can be provided to further spread it evenly over the full deck width, for example by means of a baffle (not shown). The deck 2 is inclined and its vibratory action causes the tobacco to be transported along it. A flared hood 3 is provided and beneath the hood a combination of perforated and/or perforated and plain, and perforated sheets with slots is used to cause the tobacco to become fluidised with the combination of the deck's vibrating action and air velocity introduced from a plenum 4 beneath the deck 2. Air is introduced into the plenum through suitable ducting 5 from a fan 6.

The deck 2 beneath the hood 3 is corrugated to provide higher air velocity at its peaks than in its troughs. Heavy particles fall through the fluidised carpet of tobacco thus produced which is teased open by the action of the air and vibration and fall into the troughs between the peaks of the corrugated bed. Slots (to be described in more detail) are provided through which the heavy particles fall, and the air-flow through the slots is set so that it cannot support the heavy objectionable material.

Collectors (not shown in FIG. 1) are arranged beneath the slots which transport the heavy material to a gallery 7 at one side of the bed 2 and the material progresses down the gallery to a window 8 through which it falls onto a conveyer 9. Conveyer 9 lifts the particles to a classifier 10 where any acceptable tobacco in the heavy particles is segregated and re-cycled by being passed through a ducting 11 to a separator 12 through which it is returned to the loading conveyer 1. Heavy objectionable particles are dropped out of the bottom of the classifier 10 and are passed through ducting 13 to a separator 14 from which they are ejected at 17. An extraction fan filter is indicated by reference numeral 15. Ducting 16 returns air from the separator 12 via the separator 14 to the fan filter 15.

Light objectionable particles such as dust are lifted above the top of the fluidised carpet of tobacco by the air-stream and taken to a fan-filter 18 via extraction ducting 19 leading from the top of the hood 3. As the hood 3 is flared from bottom to top, the air velocity within it is reduced from bottom to top. This prevents the fluidised carpet of tobacco from being lifted beyond fluidisation and ensures that any acceptable particles of tobacco entrained in the fluidised air drop out as its velocity reduces before it is extracted from the hood 3.

The air used to fluidise the tobacco can be of a specific temperature and RH to influence the final temperature and moisture of the tobacco at the discharge end of the vibrating bed 2.

Throughout the whole process, the bulk of the acceptable tobacco is supported on a cushion of air which produces the fluidisation required and this gentle form of support prevents the host tobacco from degrading.

Figure 2:
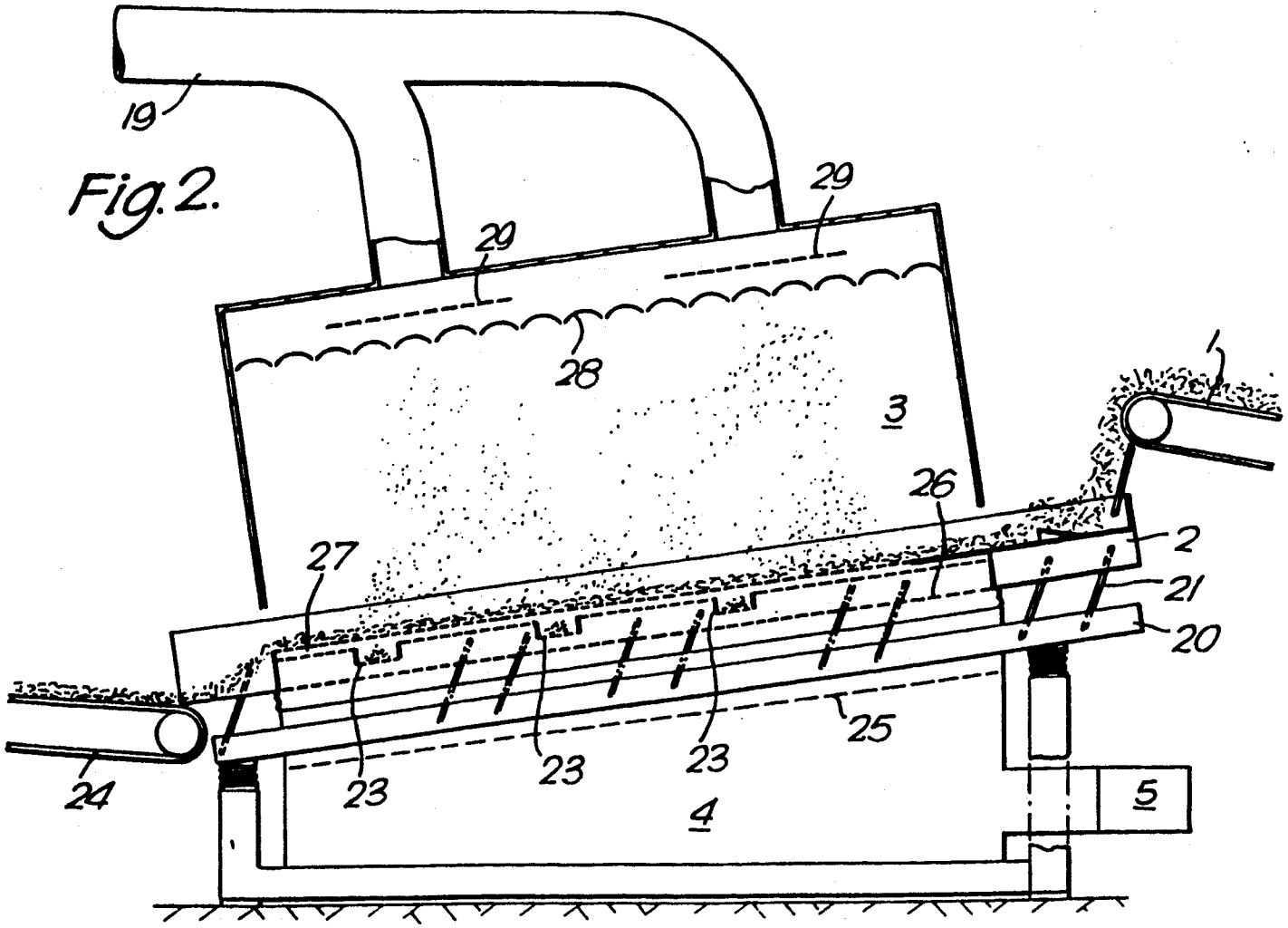
FIG. 2 is a diagrammatic cross-section through part of the apparatus shown in FIG. 1.

FIG. 2 is a diagrammatic cross-sectional view of part of the apparatus and the same numerals are used to indicated similar parts as in FIG. 1. As will be seen from FIG. 2, the vibrating deck 2 is carried on a spring-mounted frame to which it is connected by fiberglass springs 21. The deck is vibrated by a drive-arm 22 as shown in FIG. 1 and the collectors of the "heavies" are shown as channels 23. The cleaned, cut lamina emerging from the deck is delivered to a removal conveyer 24. Reference numeral 25 indicated a baffle in the plenum which acts to distribute air and reference numeral 26 indicates a further baffle in the base of the deck. The convoluted deck is preferably made with a 10% open area from perforated sheet and is indicated by reference numeral 27, but larger or smaller cores of perforation could be used.

An air deflector 28 is provided in the upper part of the hood 3 and baffles are indicated by reference numeral 29.

Figure 3:
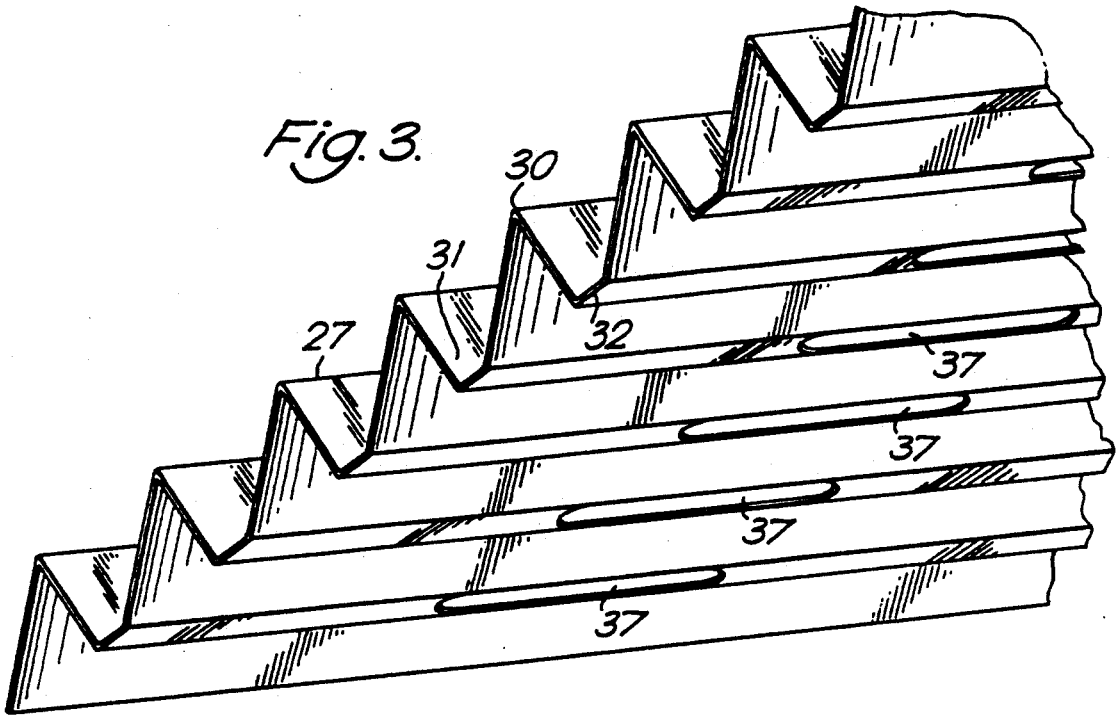
FIG. 3 is an enlarged isometric view of part of the fluidised bed deck.
Figure 7:
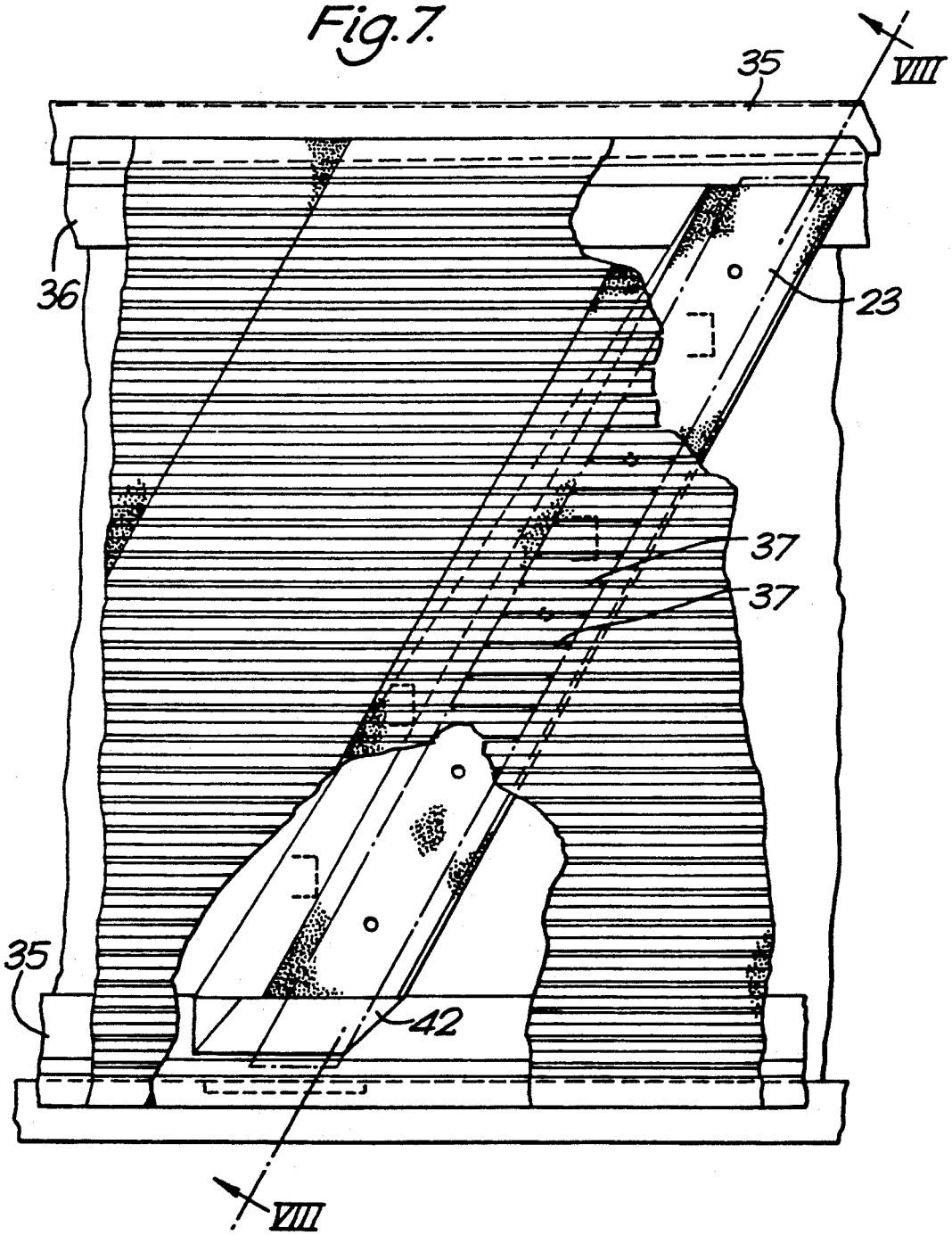
FIG. 7 is a plan view of part of the fluidised bed deck.
Figure 8:
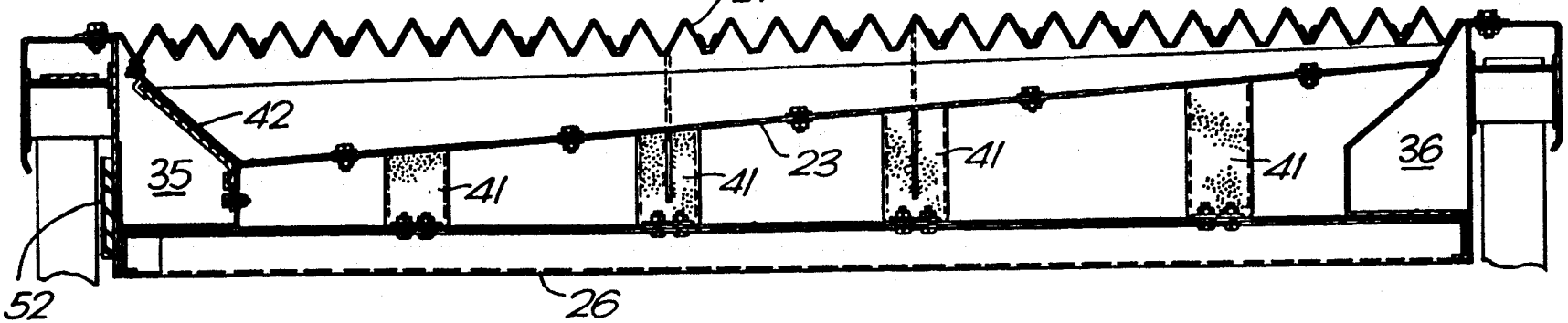
FIG. 8 is a cross-sectional view on the line VIII—VIII of FIG. 7.

The construction of the vibrating deck is shown more clearly in FIGS. 3, 7 and 8. FIG. 3 shows the corrugated deck surface with the peaks of the corrugations indicated by reference numeral 30 and the troughs by reference numeral 31. The bottom 32 of each trough is flat and the whole construction is made from perforated material so that an air flow can be passed through it. As will be seen from FIG. 8, the corrugated surface is carried on the perforated channels 23, which are connected on each side to lengthwise extending box section galleries 35 and 36. Reference to FIG. 7 will show that a row of slots 37 is provided which extends angularly across the deck, each slot being located at the bottom of one of the troughs 31. A collector channel 23 is located beneath each row of slots and additional support is provided by supports 41. It will be seen that this collector channel is angled downwardly towards the gallery 35 and is also angled across the deck. Where the channel meets the gallery 35, a window opening 42 is provided to provide communication between the gallery and the channel. The channel 23 is made from a perforated material to allow an appropriate air flow through it for the fluidised bed.

Figure 4:
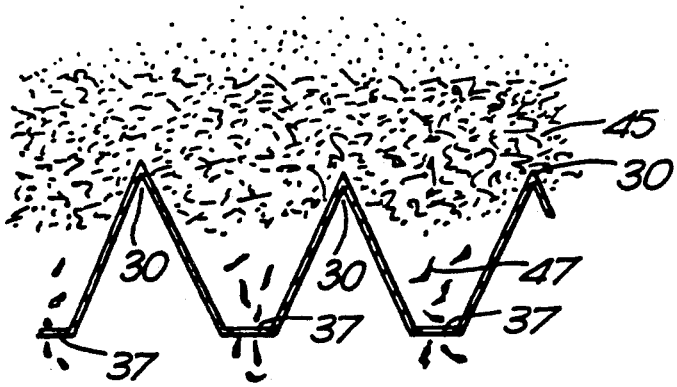
FIG. 4 is a diagrammatic view showing the relative position of a tobacco carpet on the fluidised bed deck.

FIG. 4 shows how the carpet of tobacco material indicated by reference numeral 45 is located by the fluid bed in relation to the corrugated surface provided by the deck of the bed. Approximately one third of the carpet impinges into the channels below the peaks 30 although it will be appreciated that there will be large fragments falling from the lower surface, indicated by reference numeral 47 and dust and other smaller fragments indicated by reference numeral 48 rising above it. As the peaks of the deck extend into the carpet of material, vibration of the deck is transmitted to the material, thus teasing it while it is in a fluid state. Moreover, because the vibration is transmitted to the carpet of material, it helps to move it down the conveyer thus ensuring a rapid throughput of material. It has been found that a relatively thin layer of material transported rapidly through the conveyer is more effective than moving a much thicker layer at slower speed.

Due to the angled construction of the collector channels 23, heavy material which has fallen through the openings 37 is transported across the deck and into the gallery 35 through the appropriate window 42. Because the whole deck is vibrating, the gallery 35 now acts as a conveyer to move the heavy material to the position indicated by reference numeral 8 in FIG. 1 so that it can be removed.

Figure 5:
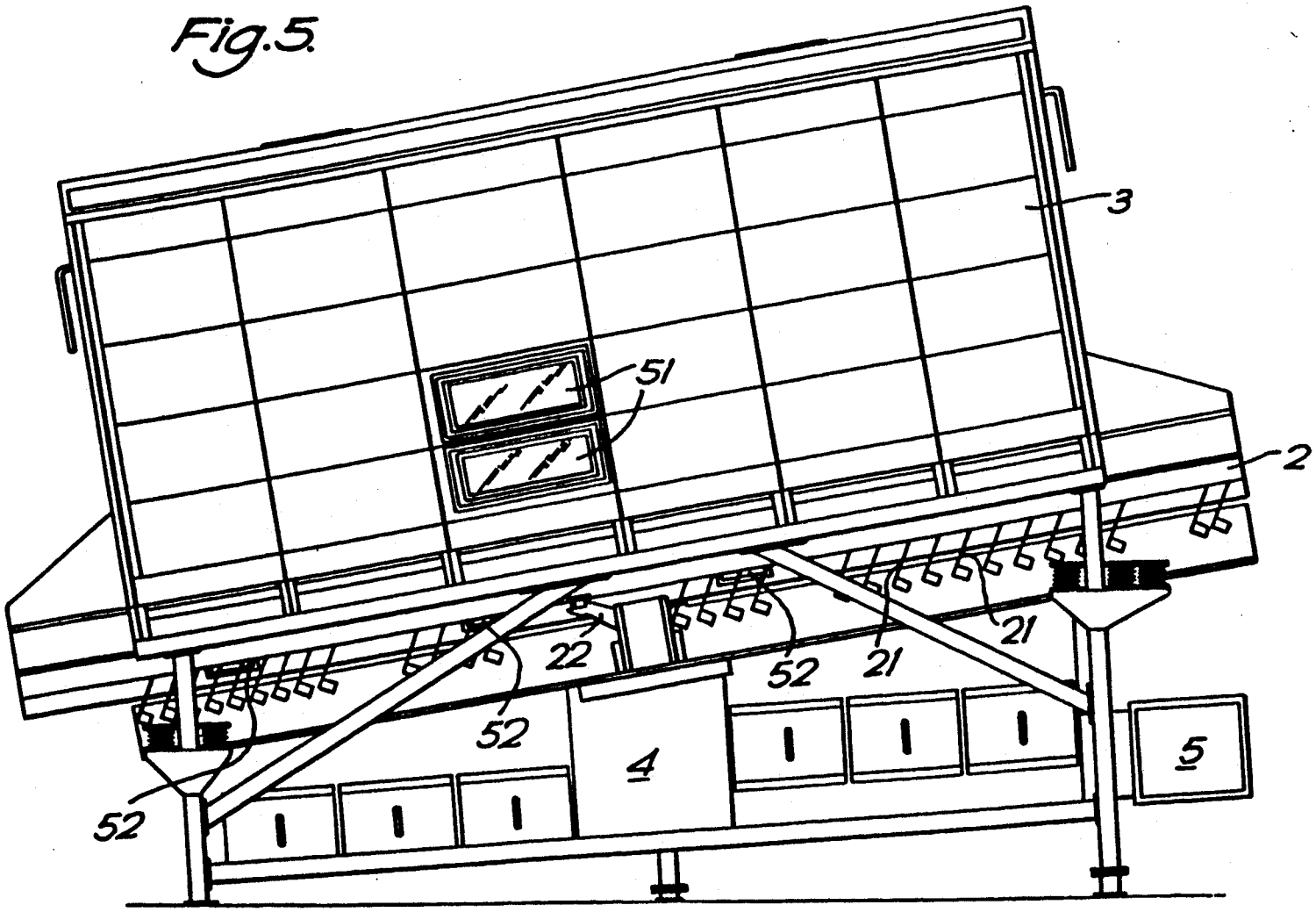
FIG. 5 is a side elevation of a part of the apparatus.

FIG. 5 shows the external construction of the deck together with its hood, the same reference numerals being used to indicate similar parts as the other FIGS.

Figure 6:
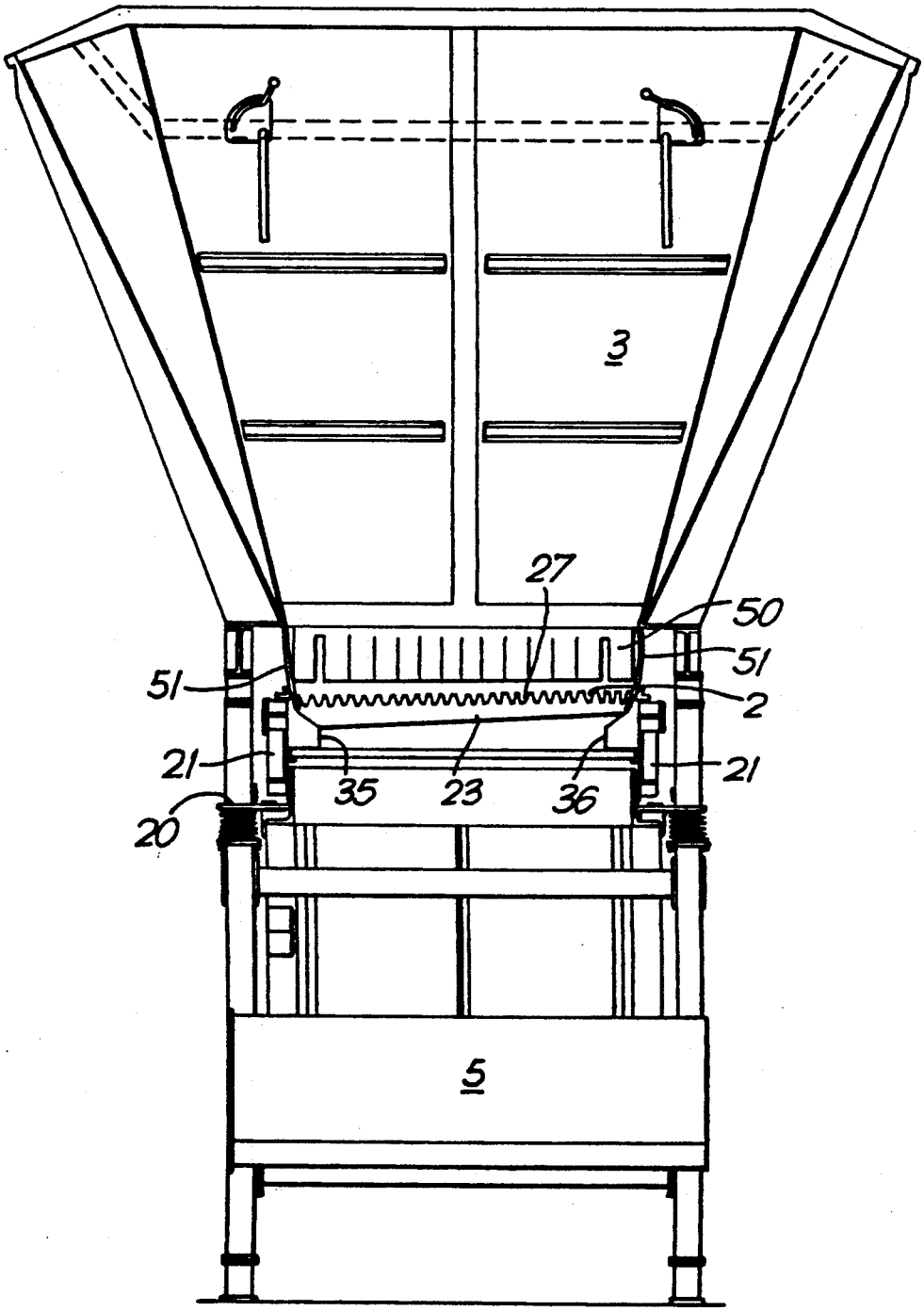
FIG. 6 is an end elevation of the apparatus shown in FIG. 5.

FIG. 6 shows the entry end of the apparatus with a part section through the deck once again employing the same reference numerals as the previous FIGS to indicate similar parts. As will be seen from FIG. 6 a nylon skirt 50 is employed at the entrance and exit, and transparent windows can be provided in the hood 3 in order to observe the process. Similarly transparent windows 52 can also be provided in the sides of the gallery 35 opposite the collector troughs 23 for observation purposes. Flexible plastics material rubbing seals 54 are provided between the hood 3 and the vibrating deck 2 and flexible seals (not shown) are also provided between the plenum 4 and the underside of the deck 2.

Figure 9:
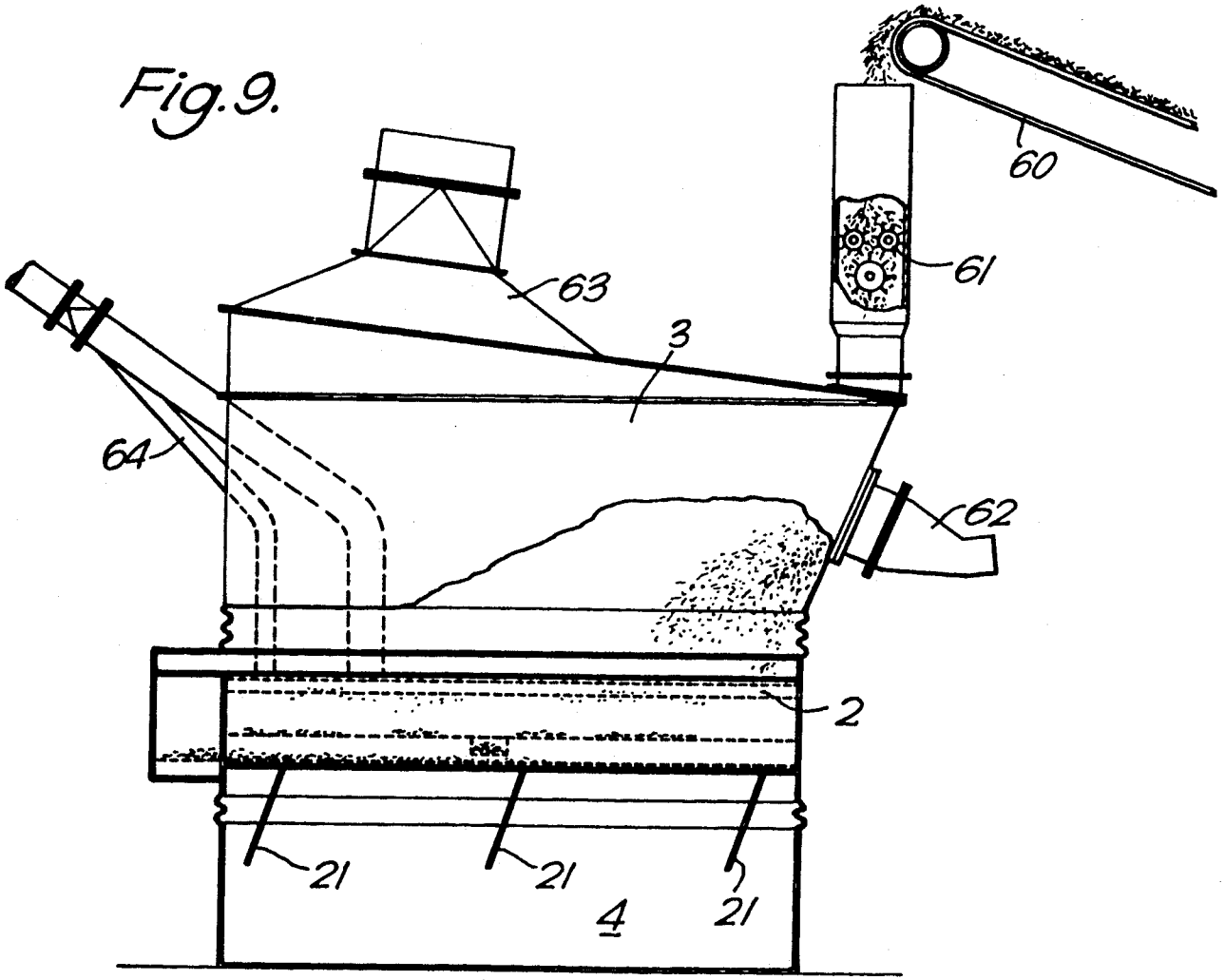
FIG. 9 is a diagrammatic cross-section through a second embodiment.

In an alternative construction shown in FIG. 9 similar reference numerals are used to indicate similar parts as shown in FIGS. 1 and 2. Thus, the deck 2 is surmounted by a hood 3 and air is supplied through a plenum chamber 4. The deck 2 is carried on a spring mounted frame to which it is connected by fiber glass springs 21 in a similar manner to the arrangement shown in FIG. 5 and the deck is vibrated by any suitable means, for example by a drive arm similar to that also shown in FIG. 5.

In this construction tobacco is conveyed via a feed conveyer 60 and it is metered into the apparatus by spiked wheels indicated by reference numeral 61 which will also act to open up the tobacco. If desired the apparatus might also be fitted with an air stream provided through a baffled duct 62 which further opens the tobacco up before it falls onto the fluidised bed 2.

Fluidised air is blown from a fan to the underside of the deck in a similar manner to that described with regard to the other Figures and the deck is perforated in the manner described above or in the manner shown in FIGS. 10 and 11 to be described hereafter. The combination of the perforations and the deck shape cause the fluidised air velocity to increase from the trough to the peaks of the convolutions or as described with regard to FIGS. 10 and 11. Tobacco particles with different aerodynamic qualities will be support at different air velocities and stratify vertically within the convolutions such that the heavy objectionable particles will be at or near the bottom of the trough and acceptable material at a higher level. Dust is carried off in the air stream through the hood 3 and a hood extraction duct 62 to a fan filter combination, again as described. The hood 3 is flared out to cause the fluidising air velocity to drop with its increase in cross-section thus ensuring that good tobacco is not carried away with the dust.

The objectionable particles again drop through slots in the deck and the vibratory action of the bed ensures that the tobacco is teased open and all particles are transported away from the infeed end.

The carpet of acceptable tobacco particles can again be discharged as described above but in the arrangement shown in FIG. 9 this acceptable material may be gently air lifted in a gentle removal air stream via suction tubes 64. In this arrangement the level of suction is kept to a minimum to limit degradation and also to ensure that any heavy objectionable particles which did not pass through the slots in the bed are left behind on the vibrating deck where they can be channelled off by the vibration and eventually pass off the apparatus with the material which falls through the slots.

The velocity of said gentle air stream will depend upon the cross section of the tube 64 and other factors, for example it can be as low as 200 feet per minute, but in a typical example is about 1,000 feet per minute which is added to the fluidising air stream.

It will be appreciated that the air lift arrangement is very soft and is merely strong enough to gently lift the tobacco away. It is not used in the normal sense or as in known constructions as a separator.

The rate of objectionable material leaving the apparatus may be measured and compared to a desired level in order to provide control by altering the velocity of air fluidising air.

Figure 10:
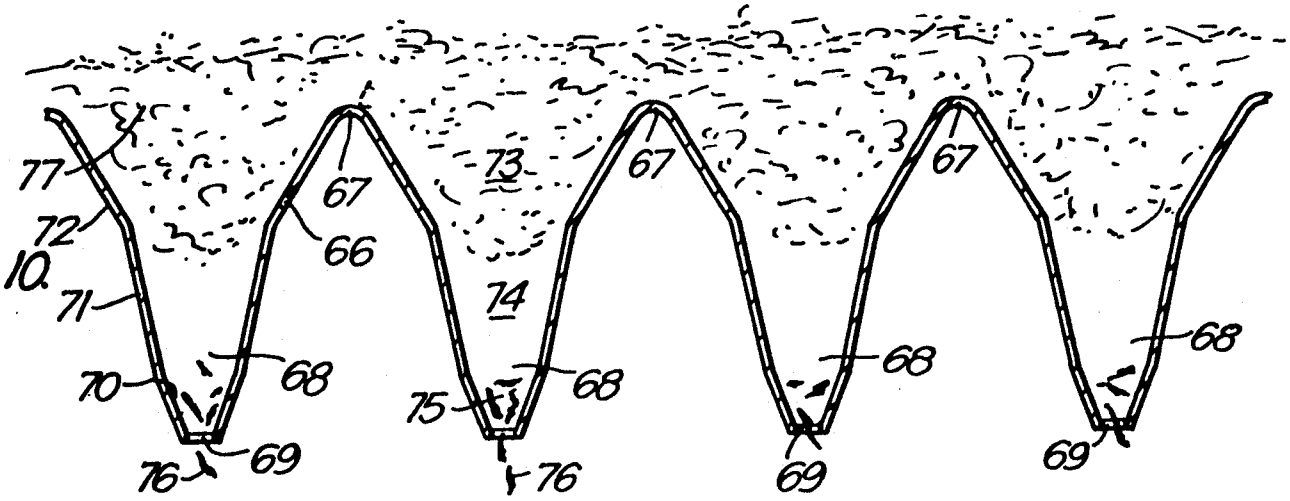
FIG. 10 is a diagrammatic cross-section of an alternative deck configuration.

In the trough construction shown in FIG. 10 the material of the deck surface is again perforated, a typical perforation being indicated by reference numeral 66. The peaks of the corrugations are indicated by reference numeral 67 and the trough by reference numeral 68. The bottom of each trough may be flat or curved and, as mentioned above, the whole construction is made from perforated material so that air flow can pass through it. Slots 69 are again provided at the bottom of each trough. As will be seen from the drawing the shape of the peaks and troughs is not triangular, for example as shown in FIG. 4, but each side wall of each trough is multi-angled. Thus at the bottom of each trough there is a first side wall portion 70 which leads into a more upright portion 71 which in turn leads into a more angled portion 72. The included angles between the portions 72 and 71 and 71 and 70 are different. The upper end of the trough 62 is rounded to lead into the next side wall. In cross-section the trough therefore has a wider angle at the area indicated by reference numeral 73 than in the middle portion 74 and it is even more restricted in the lower portion 75. The gap between the upper ends of opposed portions 71 provide what is in effect a neck. The net result of this shaping is that the velocity of the general air flow upwardly through the trough rises from the space between the lower side wall portions 70, gradually increasing until it reaches the neck between the upper ends of the opposed side walls 71, as it passes upwardly into the upper part of the trough between the opposed side walls 72 which form the peaks the velocity decreases. This effect is pronounced and provides better separation between the bottom of the trough through which unwanted particles, indicated by reference numeral 76, can fall through the openings 69 and the upper part of the trough where the carpet of tobacco, indicated by reference numeral 77, can float and be vibrated.

Figure 11:
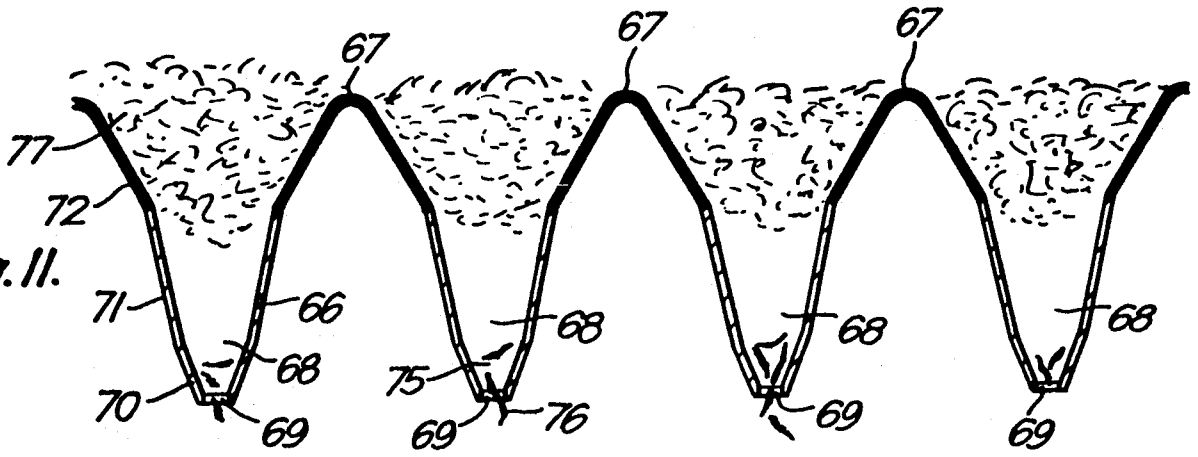
FIG. 11 is a diagrammatic cross-section of another deck configuration.

A similar construction is shown in FIG. 11 and the same reference numerals are used to indicate similar parts but in this construction the upper ends of the peaks carry no air perforations and are shown in solid lines. This portion of each peak incorporating the more angled parts of the side walls indicated by reference numeral 72. This construction offers the advantage that less air flow is required and a better separation is obtained between the bottom of the trough 69 and the carpet of tobacco 77. Moreover, the carpet of tobacco tends to lie more evenly in the upper part of the troughs so that it is contained.

Investigations have shown that the progressive separation of acceptable tobacco material from the heavier material can be achieved progressively and FIGS. 12, 13 and 14 show such progressive separation principles.

In these three FIGS. the perforated trough is indicated by reference numeral 100, the peaks at each upper side of the trough are indicated by reference numeral 101 and air is supplied to the underside of the trough through a duct 102 having baffle side walls 103 and 104.

FIGS. 12(*a*)–12(*d*) show four stages of progressively altering the shape of the trough 100. Thus at the top of the Figure the trough is a flat curved shape and is progressively curved bringing the curve in steeper as shown at the lower end of the FIG.. With a constant air flow indicated by arrow 105 the lighter acceptable tobacco indicated by reference numeral 106 progressively separates from the heavier material 107 and at the bottom of the FIG. it will be seen that the light acceptable material 106 has remained at the top of the trough between the peaks 101 and the heavy material 107 is now clearly spaced away from it at the bottom of the trough.

FIGS. 13(*a*)–13(*c*) a similar schematic progressive diagram showing how with a trough shaped substantially as shown at the bottom of FIG. 12 separation can be achieved by progressively increasing the volume of air available to the underside of the perforated shape. Thus at the top of the FIG. the air inlet for air flow 105 is relatively small but at the bottom of the FIG. the air inlet extends across the whole width of the duct.

FIGS. 14(*a*)–14(*d*) illustrate the use of combined control of air volume by entry size and distribution control by shape of the duct can provide separation. The same reference numerals are again used to indicate similar features. It should be noted that the bottom diagram in FIG. 14 is not to scale, the width of the mouth of the trough should be the same as that in the diagrams above it. From this it will be understood that with this last arrangement the base of the duct is wider than the width across the throat of the trough between the peaks 101. Alternatively the width of the mouth of the trough can be smaller than those shown above it, illustrating that progressive separation can be achieved individually, or by a combination of a progressive increase in the curve of the perforated material, an increase of the volume of air (and hence its pressure) below it or by an increase of the velocity of the air at the peaks of the curve by reducing the width of the curve in this area.

From FIGS. 12, 13 and 14 it will be appreciated that the use of baffle walls 103 and 104 enables careful control of the the air flow through the bottom and opposed side walls of the trough to give accurate control of the separation.

The principles illustrated in FIGS. 12, 13 and 14 are applied to a deck as shown in FIG. 15. In this diagrammatic cross-section of one trough in a deck, the trough is indicated by reference numeral 100. The trough has opposed side walls 110, a bottom portion 111 which is of a narrower V-shape than the side walls 110, and an upper portion formed by angled walls 112 which form peaks between the troughs. In FIG. 15 two peaks are shown each side of the trough.

The bottom and side walls of each trough are perforated and air guide means are provided by longitudinally extending baffle means in the form of spaced apart baffle walls 113, 114 which extend downwardly from the points where the side walls 110 merge into the upper walls 112 that is immediately beneath the peaks. To beneath the bottom 101 of the trough where they are joined by a lower wall 115. This wall is perforated to allow air to be supplied to an air control chamber 116 formed by the baffle walls around the trough 100.

Air is supplied to the air control chamber 116 from plenum chamber 117 below the deck, air entry being indicated by arrows 118.

With the appropriate air pressure the air control chamber around the trough together with the shape of the trough and the peaks causes the carpet of good tobacco 119 to be lifted to the throat of the trough between the peaks whilst the heavy unwanted material 120 drops downwardly.

In order to gather the unwanted heavies 120 an opening 121 is provided in the troughs 100 towards the discharge end of the deck. This discharge opening 121 leads downwardly through a passage 122 to a heavy particle discharge location 123 beneath the peak adjacent the trough concerned. The discharge location 123 is formed between the baffle walls 113 and the baffle wall of an adjacent trough (not shown in FIG. 15).

Openings 124 are provided in a lower wall 125 of the passage 122 to allow an air flow into the discharge opening to maintain separation above the opening.

FIG. 16 is a diagrammatic cross-sectional view of a deck provided with four troughs constructed as shown in FIG. 15. For ease of calibration/trimming of air flow through the passages 122 additional air flow can be provided through control opening 126 from the plenum chamber 117.

For some materials, for example CRS,-expanded tobacco and most British blends, one discharge opening per channel is sufficient to remove the majority of the winnows. Burly and Cased blends however are more difficult to open and require longer decks and may require more than one discharge opening per channel. Using several discharge openings in series together with progressively reducing the air flow through the openings will give a very discriminating and positive separation of good from bad.

FIGS. 17 and 18 show how individual/paired discharge opening control can be achieved by gating bleed in areas between the discharge openings and venting the air flow through the peaks 112.

In FIGS. 17 and 18 the same reference numerals are used to indicated similar parts as in FIGS. 15 and 16. As shown in FIG. 17 air flow through the openings 126 is bled off through control openings 127 at the upper end of each peak. The openings 127 are provided above the openings 126. With this arrangement the bleed openings 127 are more accessible than the openings 126 being above the deck and can be reduced or enlarged as required to achieve the necessary flow through the discharge openings 121. The flow out of the openings 127 is indicated by arrows 128.

FIG. 18 is a diagrammatic perspective view showing the trough 100, the peaks and the baffle walls 113 and 114. It will be appreciated that there will be further troughs on each side of the baffle walls shown. With this arrangement there are two longitudinally spaced apart discharge openings 121 in the slot but only one of which is shown in broken lines in the drawing. The entrances into the passages 122 through the baffle wall 113 are indicated by reference numeral 130. In this construction the discharge openings 121 in the trough 100 to the left of that shown also exit the drawing. These discharge openings 121 leading to openings 131 in the wall 114. Thus two troughs empty into the same discharge location 123.

For some tobaccos it may be desirable to provide means to allow good material which has inadvertently passed through the discharge openings to come out again and FIGS. 19, 20 and 21 show a construction which provides for this. Again, the same reference numerals are used to indicate similar parts as in FIG. 15. In this construction however baffle walls 135 and 136 are provided which may be vertical or as shown inclined to each other so that the cross-sectional width at their upper ends is less than the cross-sectional width across their lower ends. The discharge opening 137 is however shaped as a venturi by the side plates 138 and the gap between the side plate 135 and 138 is closed by a perforated lower wall 139, the gap between the side plate 138 and wall 136 being closed by a similar perforated lower wall 140. Extending between the plates 138 is a perforated screen 141 to catch any heavy material which has passed through the discharge opening 137.

As in the previous constructions air enters the control chamber 116 through the perforated walls 139 and 140.

The volume of air passing to the shaped trough 100 on each side of the discharge opening is controlled as before by the baffle plate angle/perforated pattern/open area of the bottom walls 139, 140 and as before the distribution of air in the trough is controlled by the shape/perforation pattern of the trough and the shape of its peak.

Instead of passing out through a discharge opening and location area combination the heavy material passes through the discharge opening 137 into a shaped section 142 where, the side walls 138 control the velocity of air coming up through the perforated screen 141 which is below a point A indicated on the drawing. This perforated screen is preferably curved, as shown, to encourage stems to orientate lengthwise on it and settle below the point A.

Any good piece of lamina which may have fallen through the discharge opening 137 will, by turbulence in the region A, lift to the area indicated by reference letter B, and subsequently if they are light enough, pass back through the discharge openings 137 to the point C and be ejected back into the shaped trough thus leaving only heavy objectionable material behind.

For trimming purposes both the perforated screen 141 and/or the perforated lower walls 139 and 140 can be masked.

FIG. 20 is a graph showing the relative air flow velocities at the various points through the trough and the discharge opening along the center line 142 in FIG. 19. It will be seen that the discharge opening now, in effect, contains a venturi which lifts the light material back out through it and ejects it back into the trough where the air velocity is controlled by the various factors referred to above. Using this configuration material is in effect classified twice as this arrangement provides two vertical tiers of classification in series thus enhancing the level of discrimination.

FIG. 21 is a diagrammatic cross-sectional view which shows that the heavy material can be carried to the end of the deck by the screen 141 and discharged at point 143. The good material 119 is taken off the deck at a higher level and discharged at point 144.

This arrangement can be used where the discharge opening is continuous throughout the length of the trough or it can be used for a long final discharge opening. If this arrangement is used as a final discharge opening in combination with previous openings their take off arrangements would be set with an air flow commensurate to only letting big heavies through. The final slot according to the construction shown in FIG. 19 will allow more material through for cleaning up. The air flow through the discharge opening at the discharge end of the deck can be arranged to be higher than its in feed end by simple masking or making the appropriate design to the geometry of the shapes below the opening.

FIG. 22 is a diagrammatic cross-section through another construction which can be used to provide the desired air flow through the trough 100. With this arrangement the upper surface of the deck is made up from perforated sheet 150 which is carried on baffle elements 151. Each baffle element has baffle walls 152, 153 and an upper wall 154. As will be seen the baffle walls are shaped to provide the air flow into the trough and the top walls 154 prevent air flow through the peaks indicated in this embodiment by reference numeral 155. Any of the discharge constructions described above can be used with this arrangement.

FIG. 23 shows a typical air velocity profile required for the bed to work. It will be seen that at the bottom of the trough the air velocity is 450 feet per minute, at a mid-point 500 feet per minute plus, as the air slows down towards the peak it reaches 450 feet and above the peak 150 feet per minute, this being the profile to provide the desired stratification effect. This profile can be achieved not only by using a variety of shapes of trough but also a variety of perforation patterns in the trough and two such arrangement are shown in FIGS. 24 and 25.

In FIG. 24 a nominal triangular shape is used with a flat bottom to the trough 100. The density of holes at the flat bottom 160 of the trough 100 is ten holes per centimeter. The lower part of the side walls 110 as indicated at 161 has eight holes per centimeter which reduces to four holes per centimeter at the top 162. Thus in this embodiment the air profile is achieved not only by the shape of the trough but also by the air guiding means provided by the particular hole pattern.

FIG. 25 shows another arrangement in which the trough 100 is substantially straight sided but the upper part of its walls 112 which form the peaks are of triangular construction. With this arrangement the perforation pattern has four holes per centimeter in the bottom 163 of the trough 100, four holes per centimeter reducing to two holes per centimeter at the upper end in the side walls 110 and two holes per centimeter in the upper side walls 112 which form the peaks.

FIGS. 26 and 27 are diagrammatic cross-sectional views of further constructions according to the invention and show how the air velocity profile required for the bed to work can also be achieved by what is, in effect, selected baffling over a flat perforated sheet. In the construction shown in FIG. 26 the bed has a number of longitudinally extending rail members 170, 171, 172. These rail members are shaped to provide together the trough side walls and peaks. Each trough 100 has diverging side walls 173, 174 which provide a throat 175 at their upper ends. The walls then diverge to provide upper walls 176, 177 which provide a mouth to the trough 100- Air is supplied to the troughs 100 from a plenum chamber 117 and due to the shape of the trough the throat 175 acts as a venturi. The air therefore accelerates upwardly through the trough 175 and then slows down again as it exits through the throat which in the construction shown in FIG. 26 is of a shallow bell shape. This type of unit, even when multi-sided shapes are used, is relatively cheap to produce and in applications where cost is critical would be a convenient design. The heavies could be taken off at any convenient point either by openings in the perforated base wall 178 or by allowing the heavies to move to the end of the deck in a manner described and shown in FIG. 21.

FIG. 27 shows another construction of somewhat similar type but in this case the rail members 180, 181, 182, 183 are shaped to provide a deeper bell shaped portion between upper walls 184,185 above the throat 186. The lower walls 187, 188 open out as shown above the support plate 178.

Although the rail sections are shown as having solid walls air bleeds into the troughs could be provided if desired to further enhance the air flow.

FIGS. 28(*a*–28(*c*) show a series of cross-sections through a peak of the type of construction shown, for example, in FIG. 15 taken at various points in the length of the deck and illustrate how just the shape of the peak can be used to increase the opening and separation of the tobacco. FIG. 29 shows a plan view of the deck incorporating this arrangement and shows two troughs 100. The sections A, B and C are indicated in FIG. 28 appropriately. The peak 190 between the troughs 100 and taken at cross-section line A—A is relatively wide and the good tobacco 119 is carried at the level of the peak and partly into the troughs 100. The section B—B which is at a mid-point in the length of the deck is approximately half the width of the peak at A—A but the width of the troughs 100 remains constant. As will be seen from FIG. 29 the troughs converge towards each other at the discharge end of the deck. The alteration in shape of the peak 190 has caused the air flow velocity to increase and the good tobacco is now raised somewhat and is only just below the peak. Finally, at section C—C at the end of the deck the peak has merely become the joint between the two side walls of the trough 100, there is air flow through the side walls as indicated by the perforated construction and the air flow is now about 800 feet per minute. This causes the good tobacco to become totally airborne and completely split from the heavy/winnows 120 which remain in the bottom of the trough. With these arrangements the final mechanical splitting/air lifting is much more positive and easier to achieve.

This type of construction can be employed with any of the other constructions described above to enable easy discharge of the good materials.

FIG. 30 shows a method of cleaning heavy materials or winnows which come out of the discharge openings and off the end of the deck. These materials may contain a small amount of good tobacco and they can be cleaned as shown in FIG. 30, which is a diagrammatic cross-sectional view of the end of the apparatus by allowing them to pass through an opening 200 in a horizontal deck 201. One side of the opening is perforated at 201 and is in communication with the plenum chamber 117. Thus as the heavies 120 pass through the opening 200 a blast of plenum air passes through them and carries any light materials away into a discharge chamber 203 . The air direction through this chamber is indicated by arrow 204 and any good materials are carried out into the flow of goods material 119 issuing from the deck and passing over a support tray 205.

This arrangement is most suitable when a mode is employed in which the good product is not air lifted off the deck.

I claim:

1. Apparatus for the separation of objectionable particles from tobacco material which comprises a deck to receive the tobacco material, means for vibrating said deck, means for providing an air flow through the deck to fluidise the tobacco material, said deck having a convoluted and at least partly perforated surfaces which provides peaks and troughs, the air velocity of said fluidising air and said peaks and troughs providing stratified air velocities over the deck to cause the tobacco material to form a carpet at least a portion of which is below the peaks but spaced above the bottoms of the troughs and which together with the vibration of the deck agitates the carpet and causes the dust to be released and rise and the heavy particles to sink, said carpet moving lengthwise along said troughs during operation to a discharge location, means for removing the released dust, means for removing the heavy particles through the deck, the combination of the shape of the deck convolutions and the performations therein cause the velocity of the fluidising air to increase from the troughs to the peaks of the convolutions, and means for lifting the acceptable material from the carpet on a gentle removal air stream and transporting it from the discharge location.

2. Apparatus for the separation of objectionable particles from tobacco material which comprises a deck to receive the tobacco material, means for vibrating said deck, means for providing an air flow through the deck to fluidise the tobacco material, said deck having a convoluted and at least partly perforated surfaces which provides peaks and troughs, the air velocity of said fluidising air and said peaks and troughs providing stratified air velocities over the deck to cause the tobacco material to form a carpet at least a portion of which is below the peaks but spaced above the bottoms of the troughs and which together with the vibration of the deck agitates the carpet and causes the dust to be released and rise and the heavy particles to sink, said carpet moving lengthwise along said troughs during operation to a discharge location, means for removing the released dust, means for removing the heavy particles through the deck, the combination of the shape of the deck convolutions and the performations therein cause the velocity of the fluidising air to increase from the troughs to the peaks of the convolutions, and said heavy particles are removed through openings in said deck.

3. Apparatus as claimed in claim 2 in which the heavy particles pass through the openings to a collector which removes them to at least one side or end of the vibration deck.

4. Apparatus for the separation of objectionable particles from tobacco material which comprises a deck to receive the tobacco material, means for vibrating said deck, means for providing an air flow through the deck to fluidise the tobacco material, said deck having a convoluted and at least partly perforated surfaces which provides peaks and troughs, the air velocity of said fluidising air and said peaks and troughs providing stratified air velocities over the deck to cause the tobacco material to form a carpet at least a portion of which is below the peaks but spaced above the bottoms of the troughs and which together with the vibration of the deck agitates the carpet and causes the dust to be released and rise and the heavy particles to sink, said carpet moving lengthwise along said troughs during operation to a discharge location, means for removing the released dust, means for removing the heavy particles through the deck, the combination of the shape of the deck convolutions and the perforations therein cause the velocity of the fluidising air to increase from the troughs to the peaks of the convolutions, and the dust is removed through a tapered extraction hood in which air velocity at its higher level is less than the air velocity at its lowest level.

5. Apparatus for the separation of objectionable particles from tobacco material which comprises a deck to receive the tobacco material, means for vibrating said deck, means for providing an air flow through the deck to fluidise the tobacco material, said deck having a convoluted and at least partly perforated surfaces which provides peaks and troughs, the air velocity of said fluidising air and said peaks and troughs providing stratified air velocities over the deck to cause the tobacco material to form a carpet at least a portion of which is below the peaks but spaced above the bottoms of the troughs and which together with the vibration of the deck agitates the carpet and causes the dust to be released and rise and the heavy particles to sink, said carpet moving lengthwise along said troughs during operation to a discharge location, means for removing the released dust, means for removing the heavy particles through the deck, the combination of the shape of the deck convolutions and the perforations therein cause the velocity of the fluidising air to increase from the troughs to the peaks of the convolutions, and heavy particles are delivered to a classifier for segregation and re-cycling.

6. Apparatus for the separation of objectionable particles from tobacco material which comprises a deck to receive the tobacco material, means for vibration said deck, means for providing an air flow through the deck to fluidise the tobacco material, said deck having a convoluted and at least partly perforated surfaces which provides peaks and troughs, the air velocity of said fluidising air and said peaks and troughs providing stratified air velocities over the deck to cause the tobacco material to form a carpet at least a portion of which is below the peaks but spaced above the bottoms of the troughs and which together with the vibration of the deck agitates the carpet and causes the dust to be released and rise and the heavy particles to sink, said carpet moving lengthwise along said troughs during operation to a discharge location, means for removing the released dust, means for removing the heavy particles through the deck, the combination of the shape of the deck convolutions and the perforations therein cause the velocity of the fluidising air to increase from the troughs to the peaks of the convolutions, and means are provided for smoothing the flow of and pre-opening the tobacco material.

7. Apparatus as claimed in claim 6 in which said means act to spread the incoming material on said vibrating deck and include deflectors.

8. Apparatus as claimed in claim 7 in which means are provided to pass the material across an air stream after the said spreading means.

9. Apparatus as claimed in claim 6 in which said means includes a spiked belt or spreader wheels, or rollers.

10. Apparatus for the separation of objectionable particles from tobacco material which comprises a deck to receive the tobacco material which comprises a deck to receive the tobacco material, means for vibrating said deck, means for providing an air flow through the deck to fluidise the tobacco material, said deck having a convoluted and at least partly perforated surfaces which provides peaks and troughs, the air velocity of said fluidising air and said peaks and troughs providing stratified air velocities over the deck to cause the tobacco material to form a carpet at least a portion of which is below the peaks but spaced above the bottoms of the troughs and which together with the vibration of the deck agitates the carpet and causes the dust to be released and rise and the heavy particles to sink, said carpet moving lengthwise along said troughs during operation to a discharge location, means for removing the released dust, means for removing the heavy particles through the deck, the combination of the shape of the deck convolutions and the perforations therein cause the velocity of the fluidising air to increase from the troughs to the peaks of the convolutions, and the combination of the shape of the deck convolutions and the perforations therein cause the velocity of the fluidising air to increase from the trough to a point below the peaks of the convolutions and to then continue upwardly at a reducing velocity.

11. Apparatus as claimed in claim 10 in which the side walls of the troughs are multi-angled to provide an upper portion with wiser angled walls than a portion beneath it.

12. Apparatus as claimed in claim 11 in which each side wall has three portions at different angles to each other to provide a trough having an upper portion with wider angled walls than a middle portion which is in turn wider angled than a lower portion.

13. Apparatus as claimed in claim 11 in which each trough includes side walls, and said trough side walls each have three portions at angles to each other to provide a trough having an upper portion with wider angled walls than a middle portion which is in turn wider angled than a lower portion.

14. Apparatus as claimed in claim 13 in which the upper portion of the trough side walls are not perforated.

15. Apparatus as claimed in claim 14 in which the cross-sectional width of the air control chamber at its lower wall is greater or smaller than at the points where the baffle walls meet the trough side walls.

16. Apparatus as claimed in claim 11 in which the upper portion of the walls of the troughs are not perforated.

17. Apparatus as claimed in claim 10 in which each trough includes side walls, and said trough side walls are multi-angled to provide an upper portion with wider angled walls than a portion beneath it.

18. Apparatus as claimed in claim 17 in which the upper portion of the trough side walls are not perforated.

19. Apparatus for the separation of objectionable particles from tobacco material which comprises a deck adapted to receive thereon tobacco material at a reception end and discharge it at a discharge end, means for vibrating said deck, means for providing an air flow through openings in the deck to fluidise the tobacco material, said deck having a convoluted surface comprising a number of longitudinally extending troughs separated by peaks, each of said troughs having a bottom, opposed side walls, and a mouth extending between adjacent peaks, air guiding means which in combination with the shape of the troughs and peaks causes the velocity of the fluidising air passing upwardly in each of said troughs to initially increase to a location spaced away from said bottom and then decrease as it exits the mouth of said trough to provide stratified air velocities over the deck to cause the tobacco material to form a carpet at least a portion of which is below the peaks but spaced above the bottom of the troughs and which together with the vibration of the deck agitates the carpet and causes the dust to be released and rise and heavy particles to sink, said carpet moving lengthwise along said troughs during operation toward said discharge locations, and means for removing the dust.

20. Apparatus as claimed in claim 19 in which the bottom and side walls of each trough are perforated and said air guiding means is provided by longitudinally extending baffle means which direct air to said perforations.

21. Apparatus as claimed in claim 20 in which the baffle means are shaped to provide an air control chamber around each trough, each chamber having spaced apart baffle beneath the peaks to points below the bottom of the trough and a lower wall joining said baffle walls and through which air is supplied to the air control chamber.

22. Apparatus as claimed in claim 19 including means for causing the tobacco carpet to lift out of the trough mouths as it approaches the discharge end of the deck.

23. Apparatus as claimed in claim 22 in which means are provided for increasing the air flow velocity in the troughs from the inlet to the discharge end of the deck.

24. Apparatus as claimed in claim 23 in which the cross-sectional widths of the peaks between the troughs decreases as a function of the length of the troughs.

25. Apparatus as claimed in claim 19 including means for removing heavy tobacco particles through the bottom of the troughs.

26. Apparatus as claimed in claim 25 in which the heavy particles are removed through discharge openings in the bottom of each trough.

27. Apparatus as claimed in claim 26 in which said discharge openings lead to a heavy particle discharge location beneath an adjacent peak.

28. Apparatus as claimed in claim 27 in which said discharge location is formed between said baffle walls of adjacent troughs.

29. Apparatus as claimed in claim 26 including means for providing an air flow into said discharge openings.

30. Apparatus as claimed in claim 29 including means for calibrating the said air flow into said discharge openings.

31. Apparatus as claimed in claim 30 in which said calibrating means includes air venting ducts in said peaks.

32. Apparatus as claimed in claim 29 in which air is supplied to said air control chambers and said discharge openings from a plenum chamber.

33. Apparatus as claimed in claim 26 in which two or more longitudinally spaced openings are provided in each trough.

34. Apparatus as claimed in claim 26 including means for controlling the air flow through the discharge openings to cause any good tobacco material which has passed therethrough to be ejected back into the trough.

35. Apparatus as claimed in claim 34 in which said discharge opening is shaped as a venturi.

36. Apparatus as claimed in claim 35 in which a perforated screen is located beneath the said discharge opening.

37. Apparatus as claimed in claim 19 in which the bottom and side walls of the troughs are perforated, said air guiding and stratification means being provided by the number and/or side of perforations per unit from the bottom of each trough up the side walls to a level beneath the peaks.

38. Apparatus as claimed in claim 19 in which the said air guiding mean openings in said deck are located in the bottom of each trough and the said air guiding means are provided by shaping the side walls and peaks to form a venturi cross-section, so that the velocity of the air flow increases up to a venturi neck and then decreases as it leaves through the mouth between the peaks.

39. Apparatus as claimed in claim 38 in which the cross-section of the trough above the venturi is bell-shaped.

40. Apparatus as claimed in claim 38 in which the deck includes a perforated sheet member on which are mounted a number of longitudinally extending rail members, the cross-sections of which are shaped to provide together the trough side wall and peaks.

* * * * *